US011448244B2

(12) United States Patent
Fukuda

(10) Patent No.: US 11,448,244 B2
(45) Date of Patent: Sep. 20, 2022

(54) HYDRAULIC SYSTEM FOR WORKING MACHINE

(71) Applicant: KUBOTA CORPORATION, Osaka (JP)

(72) Inventor: Yuji Fukuda, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 17/160,790

(22) Filed: Jan. 28, 2021

(65) Prior Publication Data

US 2021/0148386 A1 May 20, 2021

Related U.S. Application Data

(63) Continuation of application No. 16/448,529, filed on Jun. 21, 2019, now Pat. No. 10,941,793.

(30) Foreign Application Priority Data

Jun. 27, 2018 (JP) ..... JP2018-122392

(51) Int. Cl.
*F15B 21/0427* (2019.01)
*E02F 9/22* (2006.01)
*E02F 9/20* (2006.01)

(52) U.S. Cl.
CPC ..... *F15B 21/0427* (2019.01); *E02F 9/2004* (2013.01); *E02F 9/2225* (2013.01);
(Continued)

(58) Field of Classification Search
CPC .. F15B 21/04; F15B 21/0427; F15B 2211/62; F15B 2211/6343; F15B 2211/66;
(Continued)

(56) References Cited

U.S. PATENT DOCUMENTS 7,730,646 B2 * 6/2010 Kunizawa ..... E02F 3/325 37/348
8,948,983 B2 * 2/2015 Horii ..... E02F 9/22 701/50

(Continued)

FOREIGN PATENT DOCUMENTS

JP 4-219505 A 8/1992
JP 8-120709 A 5/1996

(Continued)

*Primary Examiner* — Abiy Teka
*Assistant Examiner* — Michael Quandt
(74) *Attorney, Agent, or Firm* — Greenblum & Bernstein, P.L.C.

(57) ABSTRACT

A hydraulic system includes a first output fluid tube connecting between a hydraulic pump to output operation fluid and a first operation valve to change a first pilot pressure of the operation fluid, a second output fluid tube connected between the hydraulic pump and a second operation valve to change a second pilot pressure of the operation fluid, a switching valve provided in the second output fluid tube, and a warm-up fluid tube connected between the first operation valve and the switching valve, wherein the switching valve is switched between a first position allowing the operation fluid to be drained through the first output fluid tube, the first operation valve, the warm-up fluid tube and the switching valve, and a second position allowing the operation fluid to be supplied through second output fluid tube to the second operation valve.

18 Claims, 10 Drawing Sheets

(52) U.S. Cl.
CPC ..... *E02F 9/2267* (2013.01); *E02F 9/2271* (2013.01); *E02F 9/2275* (2013.01); *E02F 9/2285* (2013.01); *E02F 9/226* (2013.01); *F15B 2211/20576* (2013.01); *F15B 2211/30505* (2013.01); *F15B 2211/3116* (2013.01); *F15B 2211/428* (2013.01); *F15B 2211/575* (2013.01); *F15B 2211/62* (2013.01); *F15B 2211/6343* (2013.01); *F15B 2211/6346* (2013.01); *F15B 2211/6355* (2013.01); *F15B 2211/67* (2013.01)

(58) Field of Classification Search
CPC ..... F15B 2211/635; F15B 2211/6355; F15B 2211/67; F15B 2211/575; F15B 2211/5753; F15B 2211/5756; F15B 2211/355; F15B 2211/36; E02F 9/2285
USPC ..... 60/329
See application file for complete search history.

(56) References Cited

U.S. PATENT DOCUMENTS

| | | | | |
|---|---|---|---|---|
| 9,328,757 | B2 * | 5/2016 | Horii | E02F 9/2203 |
| 2015/0275468 | A1 * | 10/2015 | Horii | E02F 9/2285 60/428 |

FOREIGN PATENT DOCUMENTS

| | | | |
|---|---|---|---|
| JP | 2003-184827 | A | 7/2003 |
| JP | 2013-057366 | A | 3/2013 |
| JP | 5809544 | B2 | 11/2015 |
| JP | 2017-053414 | A | 3/2017 |
| JP | 2018-084334 | A | 5/2018 |

* cited by examiner

HYDRAULIC SYSTEM FOR WORKING MACHINE

CROSS-REFERENCE TO RELATED APPLICATIONS

This application is a Continuation of U.S. application Ser. No. 16/448,529, filed Jun. 21, 2019, which claims priority under 35 U.S.C. § 119 to Japanese Patent Application No. 2018-122392, filed Jun. 27, 2018. The disclosure of each of these applications is herein incorporated by reference in its entirety.

BACKGROUND OF THE INVENTION

Field of the Invention

The present invention relates to a hydraulic system for a working machine such as a skid steer loader, a compact truck loader, and a backhoe.

Description of Related Art

A technique for warming up a working machine disclosed in Japanese Patent Publication No. 5,809,544 is previously known.

The working machine disclosed in Japanese Patent Publication No. 5,809,544 includes a pilot pressure control valve configured to control a pressure of a pilot fluid outputted from a pump and supplied to a supply target, and includes a valve body in which the pilot pressure control valve is incorporated.

In the working machine disclosed in Japanese Patent Publication No. 5,809,544, the valve body is provided with a heat-up fluid tube into which the pilot fluid outputted from the pump flows. In this manner, the pilot fluid flowing into the heat-up fluid tube is supplied to a pilot fluid tank through a relief valve or a throttle, and thus the valve body is heated up.

SUMMARY OF THE INVENTION

A hydraulic system includes a first output fluid tube connecting between a hydraulic pump to output operation fluid and a first operation valve to change a first pilot pressure of the operation fluid, a second output fluid tube connected between the hydraulic pump and a second operation valve to change a second pilot pressure of the operation fluid, a switching valve provided in the second output fluid tube, and a warm-up fluid tube connected between the first operation valve and the switching valve, wherein the switching valve is switched between a first position allowing the operation fluid to be drained through the first output fluid tube, the first operation valve, the warm-up fluid tube and the switching valve, and a second position allowing the operation fluid to be supplied through second output fluid tube to the second operation valve.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
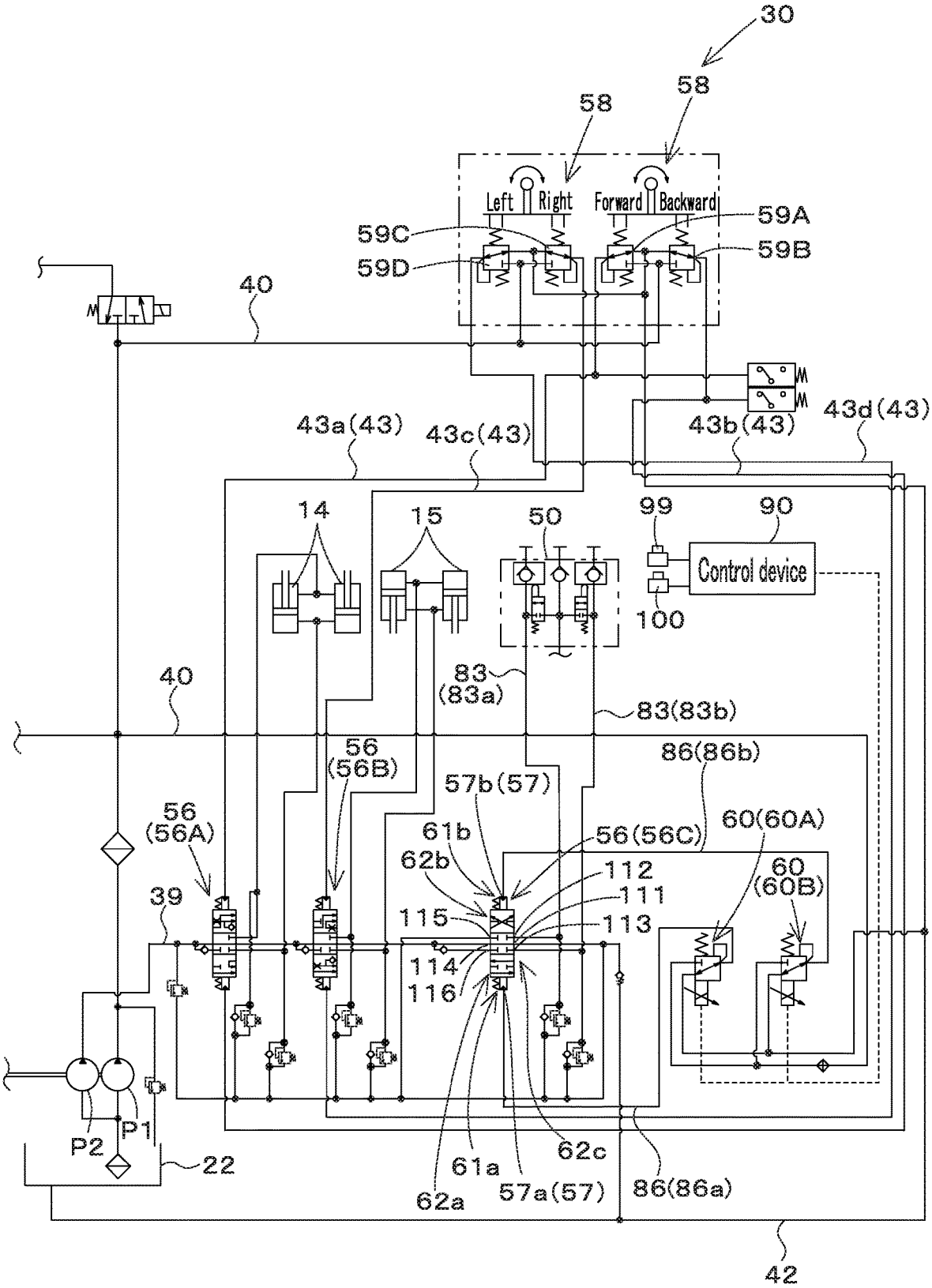
FIG. 1 is a schematic view of a hydraulic system (a hydraulic circuit) according to a first embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described with reference to the drawings.

First Embodiment

Figure 8:
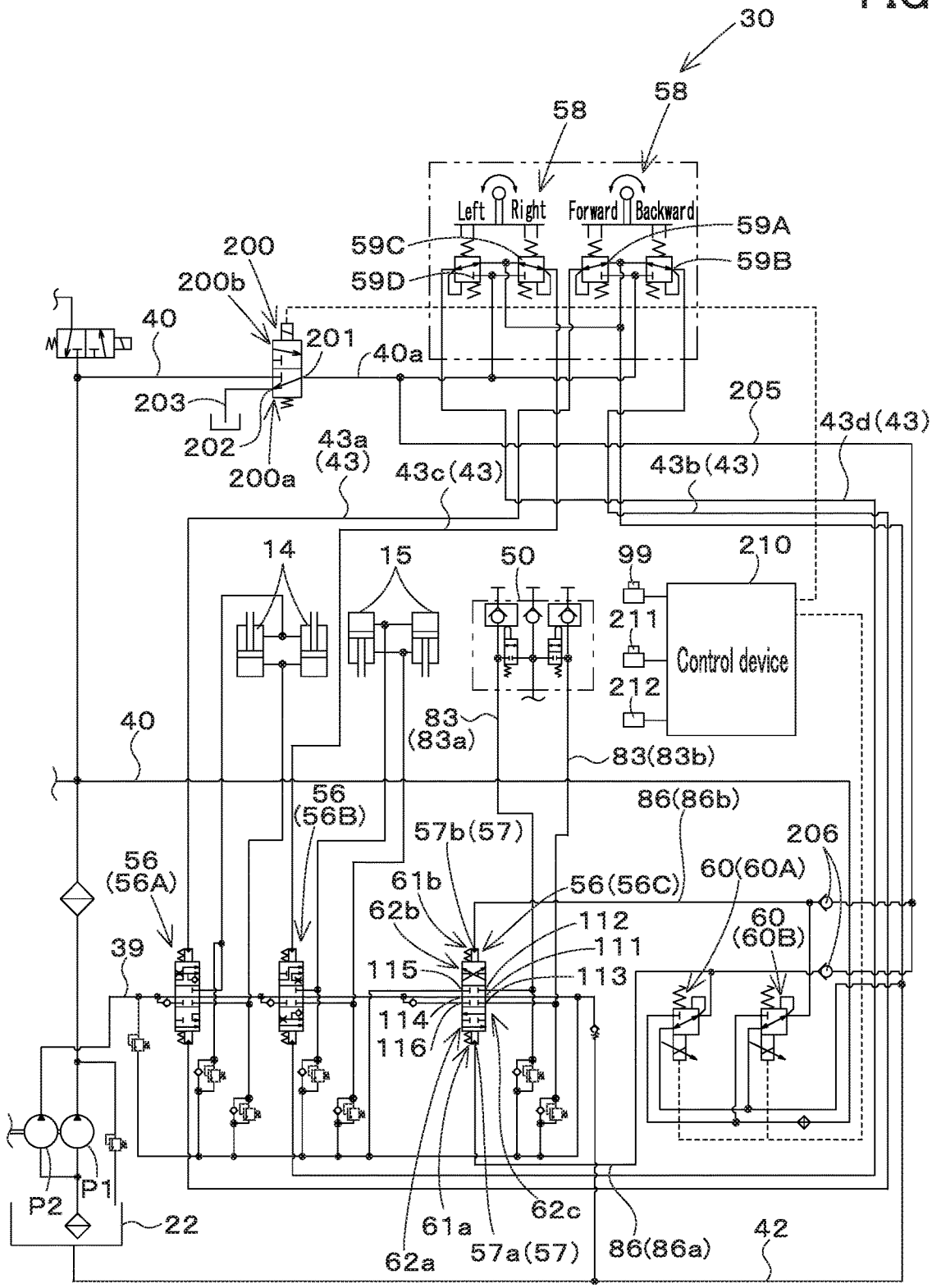
FIG. 8 is a schematic view of a hydraulic system (a hydraulic circuit) according to a fourth embodiment of the present invention.

FIG. 8 shows a side view of a working machine according to a first embodiment of the present invention. In FIG. 8, a compact track loader is shown as an example of the working machine. However, the working machine according to the present invention is not limited to the compact track loader, and may be, for example, another type of loader working machine such as a skid steer loader. In addition, a working machine other than the loader working machine may be employed.

Figure 9:
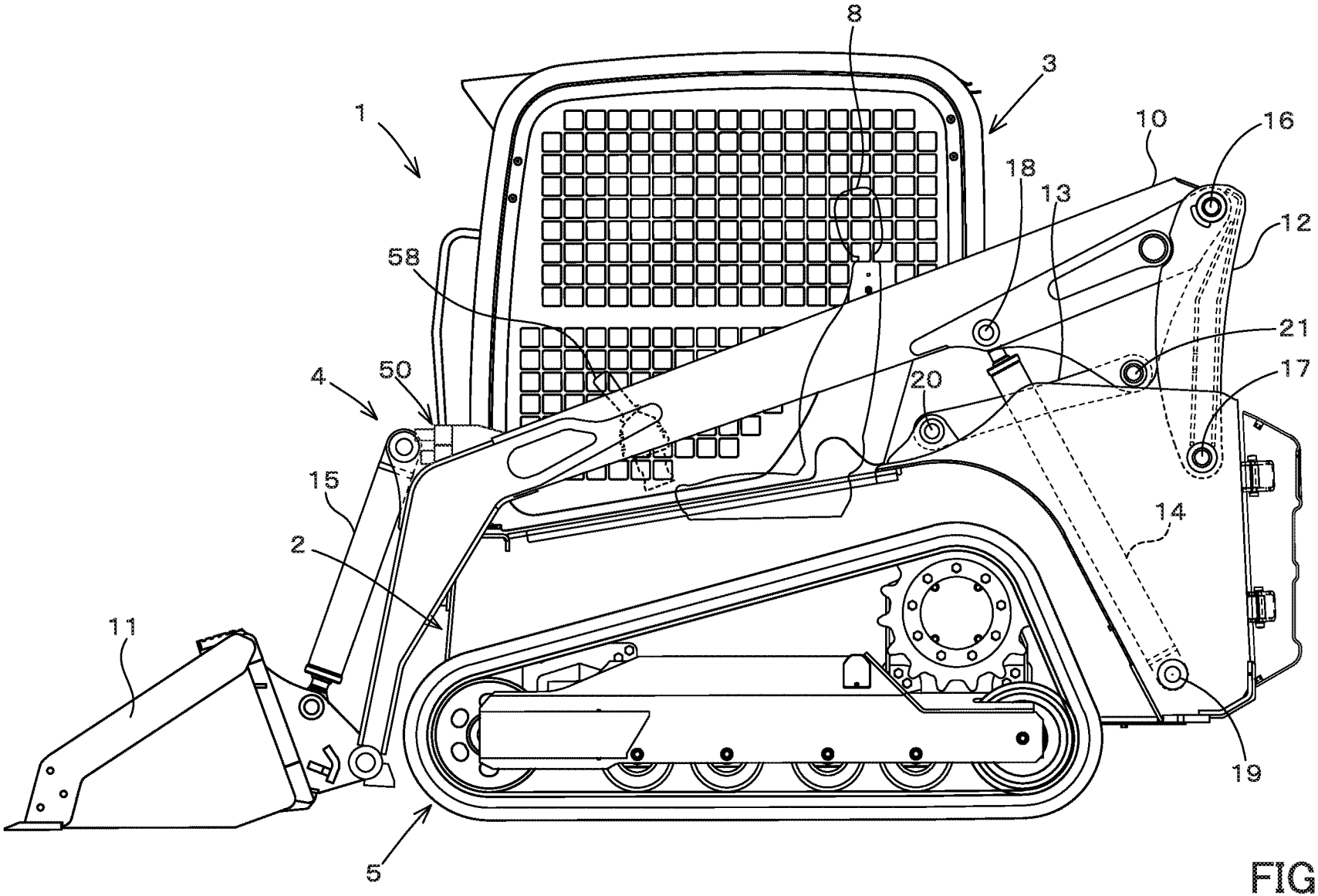
FIG. 9 is a whole view illustrating a track loader exemplified as a working machine according to the embodiments.
Figure 10:
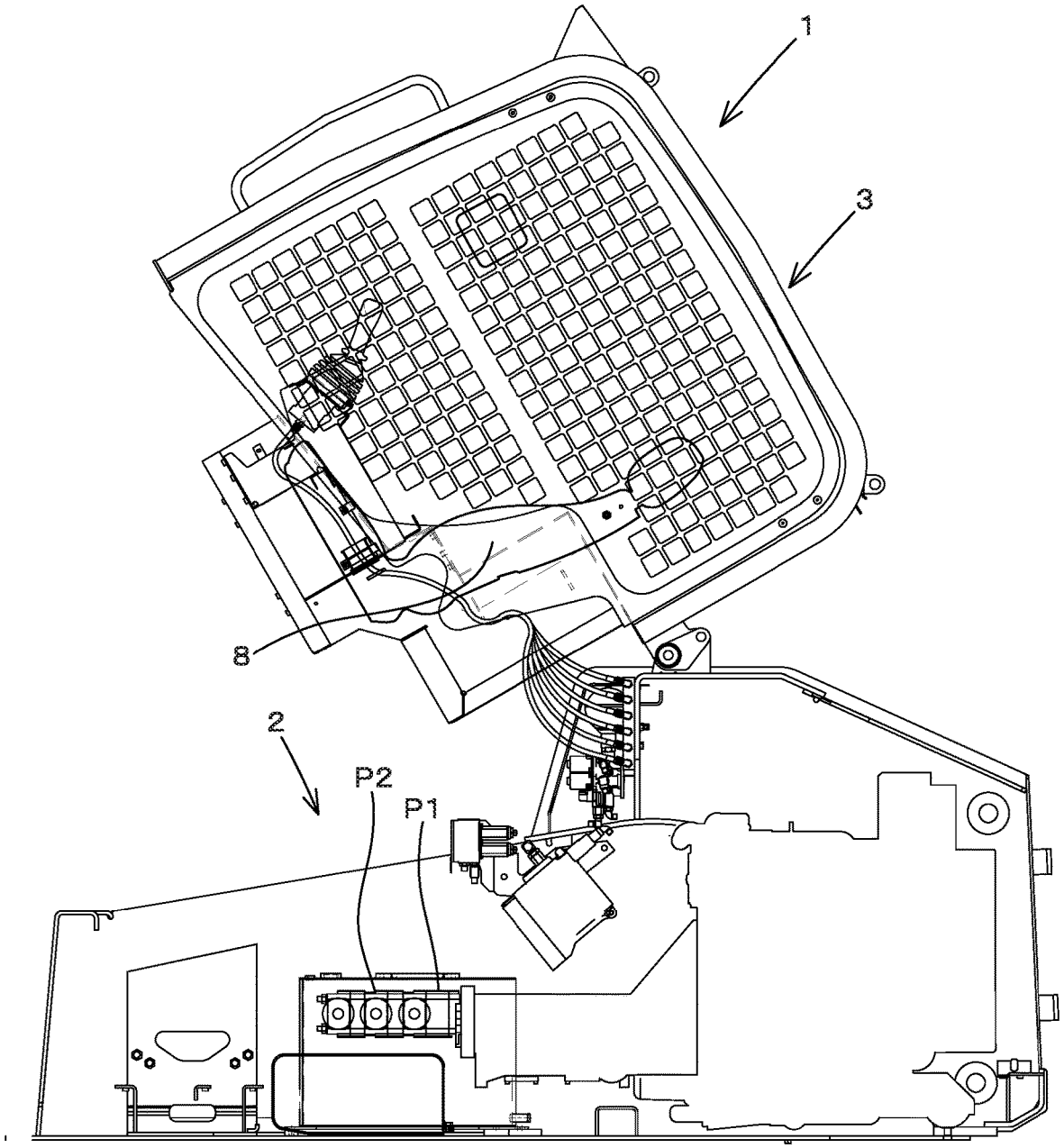
FIG. 10 is a side view illustrating a part of the track loader lifting up a cabin according to the embodiments.

As shown in FIG. 9 and FIG. 10, the working machine 1 includes a machine body 2, a cabin 3, a working device 4, and a traveling device 5. In the embodiment of the present invention, the front side of the operator seated on the operator seat 8 of the working machine 1 (the left side in FIG. 9) is referred to as the front, the rear side of the operator (the right side in FIG. 9) is referred to as the rear, the left side of the operator (the front surface side of FIG. 9) is referred to as the left, and the right side of the operator (the back surface side of FIG. 9) is referred to as the right.

In addition, the horizontal direction which is a direction orthogonal to the front-rear direction is referred to as a machine width direction in the explanation. The direction extending from the central portion of the machine body 2 to the right portion or to the left portion will be referred to as a machine outward direction. In other words, the machine outward direction is the machine width direction and is the direction separating away from the machine body 2. In the explanation, a direction opposite to the machine outward direction is referred to as a machine inward direction. In other words, the machine inward direction is the machine width direction and is the direction approaching the machine body 2.

The cabin 3 is mounted on the machine body 2. The cabin 3 is provided with an operator seat 8. The working device 4 is mounted on the machine body 2. The traveling device 5 is provided on the outer side of the machine body 2. A prime mover is mounted on a rear portion of the machine body 2.

The working device 4 includes a boom 10, a working tool 11, a lift link 12, a control link 13, a boom cylinder 14, and a bucket cylinder 15.

The boom 10 is provided on the right side of the cabin 3 and is configured to be swung upward and downward. Another boom 10 is provided on left side of the cabin 3 and is configured to be swung upward and downward. The working tool 11 is, for example, a bucket, and the bucket 11 is provided at the tip end portion (a front end portion) of the boom 10 so as to be swung upward and downward.

The lift link 12 and the control link 13 support the base portion (a rear portion) of the boom 10 so that the boom 10 is swung upward and downward. The boom cylinder 14 is configured to be stretched and shortened to move the boom 10 upward and downward. The bucket cylinder 15 is configured to be stretched and shortened to swing the bucket 11.

The front portions of booms 10 arranged on the right side and on the left side are coupled by a deformed connecting pipe. The base portions (rear portions) of the booms 10 are coupled by a circular connecting pipe.

Two pairs of the lift links 12, the control links 13, and the boom cylinders 14 are respectively provided on the left side and the right side of the machine body 2, corresponding to the booms 10 arranged on the left side and the right side.

The lift link 12 is provided longitudinally at the rear portion of the base of each of the booms 10. The upper portion (one end side) of the lift link 12 is pivotally supported by a pivot shaft 16 (a first pivot shaft) near the rear portion of the base of each of the booms 10 and is configured to be rotated about a lateral axis.

In addition, the lower portion (the other end side) of the lift link 12 is pivotally supported by a pivot shaft 17 (a second pivot shaft) near the rear portion of the machine body 2 and is configured to be rotated about the lateral axis. The second pivot shaft 17 is provided below the first pivot shaft 16.

An upper portion of the boom cylinder 14 is pivotally supported by the pivot shaft 18 (a third pivot) so that the upper portion of the boom cylinder 14 is freely turned about the lateral axis. The third pivot shaft 18 is provided at a base portion of each of the booms 10, that is, at the front portion of the base portion. The lower portion of the boom cylinder 14 is pivotally supported by the pivot shaft 19 (a fourth pivot) so that the lower portion of the boom cylinder 14 is freely turned about the lateral axis. The fourth pivot shaft 19 is provided below the third pivot shaft 18 and near the lower portion of the rear of the machine body 2.

The control link 13 is provided in front of the lift link 12. One end of the control link 13 is pivotally supported by a pivot shaft 20 (a fifth pivot shaft) so that the one end of the control link 13 is freely turned about the lateral axis. The fifth pivot shaft 20 is provided at a position corresponding to the front portion of the lift link 12 in the machine body 2.

The other end of the control link 13 is pivotally supported by a pivot shaft 21 (a sixth pivot shaft) so that the other end of the control link 13 is freely turned about the lateral axis. The sixth pivot shaft 21 is provided in front of the second pivot shaft 17 and above the second pivot shaft 17 in the boom 10.

When the boom cylinder 14 is stretched and shortened, each of the booms 10 is swung upward and downward around the first pivot shaft 16 while the base portion of each of the booms 10 is supported by the lift link 12 and the control link 13. In this manner, the tip end portion of each of the booms 10 is moved upward and downward. The control link 13 is swung upward and downward around the fifth pivot 20 in accordance with the upward and downward swinging of each of the booms 10. The lift link 12 is swung forward and backward around the second pivot shaft 17 in accordance with the upward and downward swinging of the control link 13.

Instead of the bucket 11, another working tool can be attached to the front portion of the boom 10. The other working tool is, for example, an attachment (an auxiliary attachment) such as a hydraulic crusher, a hydraulic breaker, an angle broom, an earth auger, a pallet fork, a sweeper, a mower, a snow blower, or the like.

A coupling member 50 is provided at the front portion of the left boom 10. The coupling member 50 is a device that couples the hydraulic device provided to the auxiliary attachment to the first piping member such as a pipe provided to the boom 10.

In particular, the first piping member can be connected to one end of the coupling member 50, and a second piping member can be connected to the other end of the coupling member 50 connected to the hydraulic device of the auxiliary attachment. In this manner, the operation fluid flowing in the first piping member flows through the second piping member and is supplied to the hydraulic device.

The bucket cylinders 15 are respectively disposed near the front portions of booms 10. When the bucket cylinder 15 is stretched and shortened, the bucket 11 is swung.

In the present embodiment, crawler type traveling devices (including semi crawler type traveling devices) are adopted to the traveling devices 5 arranged on the left side and the right side. In addition, a traveling device of wheel type which has a front wheel and a rear wheel may be employed.

Next, the hydraulic system 30 for the working machine according to the embodiment of the present invention will be described below.

As shown in FIG. 1, the hydraulic system 30 is a hydraulic system 30 of an operating system configured to operate the boom 10, the bucket 11, the auxiliary attachment and the like. In addition, the hydraulic system 30 of the operating system includes a plurality of control valves 56, a first hydraulic pump P1 (a hydraulic pump), and a second hydraulic pump P2 (a hydraulic pump).

The first hydraulic pump P1 is a pump configured to be driven by the power of the prime mover, and is constituted of a constant displacement gear pump. The first hydraulic pump P1 is configured to output the operation fluid stored in the tank 22. In particular, the first hydraulic pump P1 outputs the operation fluid mainly used for control.

The second hydraulic pump P2 is a pump installed at a position different from that of the first hydraulic pump P1, and is constituted of a constant displacement gear pump. The second hydraulic pump P2 is configured to output the operation fluid stored in the operation fluid tank 22. In particular, the second hydraulic pump P2 outputs the operation fluid that mainly operates the hydraulic actuator.

A main fluid tube (a fluid tube) 39 is provided on the outlet side of the second hydraulic pump P2. The plurality of control valves 56 are connected to the main fluid tube 39. The control valves 56 are valves configured to switch the flow direction of the operation fluid with use of the pilot pressure of the pilot fluid.

In addition, the control valve 56 is a valve configured to control the hydraulic device. The hydraulic device is a device for controlling (driving) a hydraulic device such as a boom, a bucket, a hydraulic crusher, a hydraulic breaker, an angle broom, an earth auger, a pallet fork, a sweeper, a mower, a snow blower, or the like, for example, a hydraulic cylinder, a hydraulic motor, or the like.

As shown in FIG. 1, the plurality of control valves 56 include a first control valve 56A, a second control valve 56B, and a third control valve 56C. The first control valve 56A is a valve configured to control a hydraulic cylinder (a boom cylinder) 14, the hydraulic cylinder 14 being configured to control the boom 10. The second control valve 56B is a valve configured to control a hydraulic cylinder (a bucket cylinder) 15, the hydraulic cylinder 15 being configured to control the bucket 11.

The third control valve 56C is a valve for controlling a hydraulic device (a hydraulic cylinder and a hydraulic motor) mounted on an auxiliary attachment such as a hydraulic crusher, a hydraulic breaker, an angle broom, an earth auger, a pallet fork, a sweeper, a mower, a snow blower, or the like.

Each of the first control valve 56A and the second control valve 56B is a direct-acting spool three-position switching valve of pilot-operated type. The first control valve 56A and the second control valve 56B are configured to be switched by the pilot pressure between a neutral position, a first position different from the neutral position, and a second position different from the neutral position and the first position.

The boom cylinder 14 is connected to the first control valve 56A by a fluid tube, and the bucket cylinder 15 is connected to the second control valve 56B by a fluid tube.

The operations of the boom 10 and the bucket 11 can be conducted by an operation member such as an operation lever 58 provided around the operator seat 8. The operation lever (second operation member) 58 is supported so as to be capable of tilting in the front, the rear, the left, the right, and the diagonal directions from the neutral position. By tilting the operation lever 58, it is possible to operate the plurality of pilot valves (operation valves) 59A, 59B, 59C, and 59D provided at the lower portion of the operation lever 58.

That is, the plurality of pilot valves (the operation valves) 59A, 59B, 59C, and 59D change the flow rate of the operation fluid on the basis of the operation of the operation member 58. The pilot valves 59A, 59B, 59C, and 59D are coupled to the first hydraulic pump P1 by an output fluid tube 40.

In addition, the pilot valves 59A, 59B, 59C, and 59D have a discharge port (a port) connected to the operation fluid tank 22, and are connected to the operation fluid tank 22 by the discharge fluid tube 42.

The plurality of pilot valves (the operation valves) 59A, 59B, 59C, and 59D are coupled each other to the plurality of control valves 56 by the plurality of fluid tubes 43*a*, 43*b*, 43*c*, and 43*d*. In particular, the pilot valve 59A is connected to the first control valve 56A by a fluid tube 43*a*.

The pilot valve 59B is coupled to the first control valve 56A by a fluid tube 43*b*. The pilot valve 59C is coupled to the second control valve 56B by a fluid tube 43*c*. The pilot valve 59D is coupled to the second control valve 56B by a fluid tube 43*d*.

Each of the pilot valves (the operation valves) 59A, 59B, 59C, and 59D can set the pressure of the operation fluid to be output in accordance with the operation of the operation lever 58.

In particular, when the control lever 58 is tilted forward, the pilot valve (the operation valve) 59A for lowering is operated to set the pilot pressure of the pilot fluid to be outputted from the pilot valve 59A for lowering. The pilot pressure is applied to the pressure receiving portion of the first control valve 56A, the boom cylinder 14 is shortened, and then the boom 10 is moved downward lowered.

When the control lever 58 is tilted backward, the valve (the control valve) 59B for lifting is operated to set the pilot pressure of the pilot fluid to be outputted from the pilot valve 59B for lifting. The pilot pressure is applied to the pressure receiving portion of the first control valve 56A, the boom cylinder 14 is stretched, and then the boom 10 is moved upward.

When the control lever 58 is tilted to the right, the pilot valve (the control valve) 59C for bucket dumping is operated to set the pilot pressure of the pilot fluid to be outputted from the pilot valve 59C. The pilot pressure is applied to the pressure receiving portion of the second control valve 56B, and the bucket cylinder 15 is stretched, and then the bucket 11 performs the dumping operation.

When the control lever 58 is tilted to the left, the pilot valve (the control valve) 59D for the bucket shoveling is operated to set the pilot pressure of the pilot fluid to be outputted from the pilot valve 59D. The pilot pressure is applied to the pressure receiving portion of the second control valve 56B, the bucket cylinder 15 is shortened, and then the bucket 11 performs the shoveling operation.

The third control valve 56C is a direct-acting spool three-position switching valve of pilot-type. The third control valve 56C is switched between the first position 62*a*, the second position 62*b*, and the third position (the neutral position) 62*c* by the pilot pressure. That is, the third control valve 56C is switched to the first position 62*a*, to the second position 62*b*, or to the third position 62*c* to control the direction, the flow rate, and the pressure of the operation fluid flowing to the hydraulic device of the auxiliary attachment.

An supplying-discharging fluid tube 83 is connected to the third control valve 56C. One end of the supplying-discharging fluid tube 83 is connected to the supplying-discharging port 57 of the third control valve 56C, the middle portion of the supplying-discharging fluid tube 83 is connected to the coupling member 50, and the other end of the supplying-discharging fluid tube 83 is connected to the hydraulic device of the auxiliary attachment. The supplying-discharging fluid tube 83 is constituted of the first piping member and the second piping member as described above, for example.

In particular, the supplying-discharging fluid tube 83 includes a first supplying-discharging fluid tube 83*a* configured to couple the first supplying-discharging port 57*a* of the third control valve 56C to the first port of the coupling member 50. In addition, the supplying-discharging fluid tube 83 includes a second supplying-discharging fluid tube 83*b* configured to couple the second supplying-discharging port 57*b* of the third control valve 56C to the second port of the coupling member 50.

That is, by operating the third control valve 56C, the operation fluid can be supplied from the third control valve 56C toward the first supplying-discharging fluid tube 83*a*. In addition, by operating the third control valve 56C, the operation fluid can be supplied from the third control valve 56C toward the second supplying-discharging fluid tube 83*b*.

The third control valve 56C includes the pressure receiving portions 61*a* and 61*b* that receive the pressure of operation fluid, and is operated by the plurality of proportional valves (the operation valves) 60. To explain in particular, the operation fluid supplied from the proportional valves 60 are applied to the pressure receiving portions 61*a* and 61*b*, and thereby the third control valve 56C is operated.

The proportional valve 60 is a solenoid valve whose an opening aperture can be changed by the magnetization. The plurality of proportional valves 60 include a first proportional valve 60A and a second proportional valve 60B. An output fluid tube 40 is connected to the first proportional valve 60A and to the second proportional valve 60B. The pilot fluid, which is a part of the operation fluid to be used for control, is supplied from the first hydraulic pump P1 to the first proportional valve 60A and the second proportional valve 60B.

Hereinafter, for convenience of the explanation, the operation fluid applied to the pressure receiving portions 61*a* and 61*b* may be referred to as the pilot fluid.

The third control valve 56C is coupled to the proportional valves 60 (the first proportional valve 60A and the second proportional valve 60B) by a control fluid tube 86.

The control fluid tube 86 is a fluid tube that allows the pilot fluid to be supplied to the third control valve 56C through the proportional valves 60 (the first proportional valve 60A and the second proportional valve 60B). The control fluid tube 86 is constituted of a steel pipe, a pipe, a hose, or the like. The control fluid tube 86 includes the first control fluid tube 86*a* and the second control fluid tube 86*b*.

The first control fluid tube 86*a* is a fluid tube coupling the first proportional valve 60A to the pressure receiving portion 61*a* of the third control valve 56C. The second control fluid tube 86*b* is a fluid tube coupling the second proportional valve 60B to the pressure receiving portion 61*b* of the third control valve 56C.

Thus, when the first proportional valve 60A is opened, the pilot fluid is applied to the pressure receiving portion 61*a* of the third control valve 56C through the first control fluid tube 86*a*. In addition, the pilot pressure applied (acted) to the pressure receiving portion 61*a* is determined by the opening aperture of the first proportional valve 60A. When the pilot pressure applied to the pressure receiving portion 61*a* becomes equal to or higher than a predetermined pressure, the movement of the spool S switches the third control valve 56C from the third position (the neutral position) 62*c* to the first position 62*a*.

In addition, when the second proportional valve 60B is opened, the pilot fluid is applied to the pressure receiving portion 61*b* of the third control valve 56C through the second control fluid tube 86*b*, and the pilot pressure to be applied to the pressure receiving portion 61*b* is determined by the opening aperture of the second proportional valve 60B. When the pilot pressure applied to the pressure receiving portion 61*b* becomes equal to or higher than a predetermined pressure, the movement of the spool S switches the third control valve 56C from the third position (the neutral position) 62*c* to the second position 62*b*.

The control device 90 performs magnetization or the like of the proportional valves 60 (the first proportional valve 60A and the second proportional valve 60B). The control device 90 is constituted of a CPU or the like. An operation member (a first operation member) 99 is connected to the control device 90. The control device 90 magnetizes the proportional valves 60 in accordance with the operation extent (for example, the sliding amount, the swinging amount, and the like) of the operation member 99, and thereby adjusts (controls) the opening apertures of the proportional valves 60.

The operation member 99 is a seesaw type switch configured to be swingable, a slide type switch configured to be slidable, a push type switch configured to be pushable, or the like. That is, the plurality of proportional valves 60 (the first proportional valve 60A and the second proportional valve 60B) change the flow rate of the pilot fluid in accordance with the operation of the operation member 99.

To be explained in particular, in the case where the operation member 99 is constituted of a seesaw type switch 99, the control device 90 magnetizes the first proportional valve 60A to open the first proportional valve 60A when the seesaw type switch 99 is swung in one direction.

In other words, when the seesaw switch 99 is swung in one direction, the first proportional valve 60A is opened, and the pilot fluid is applied to the pressure receiving portion 61*a* of the third control valve 56C through the first control fluid tube 86*a*.

When the pilot pressure applied to the pressure receiving portion 61*a* becomes equal to or higher than a predetermined pressure, the movement of the spool S switches the third control valve 56C from the third position (the neutral position) 62*c* to the first position 62*a*. On the other hand, when the seesaw switch 99 is swung in the other direction, the control device 90 magnetizes the second proportional valve 60B to open the second proportional valve 60B.

In other words, when the seesaw switch 99 is swung in the other direction, the second proportional valve 60B is opened, and then the pilot fluid is applied to the pressure receiving portion 61*b* of the third control valve 56C through the second control fluid tube 86*b*. When the pilot pressure applied to the pressure receiving portion 61*b* becomes equal to or greater than a predetermined value, the movement of the spool S switches the third control valve 56C from the third position (the neutral position) 62*c* to the second position 62*b*.

Next, the third control valve 56C will be described in detail.

Hereinafter, for convenience of the explanation, in FIG. 2 to FIG. 4, the left side of the drawing is referred to as the left, the right side of the drawing is referred to as the right, the left direction and the right direction are referred to as the lateral direction, and the direction orthogonal to the lateral direction is referred to as the longitudinal direction.

Figure 2:
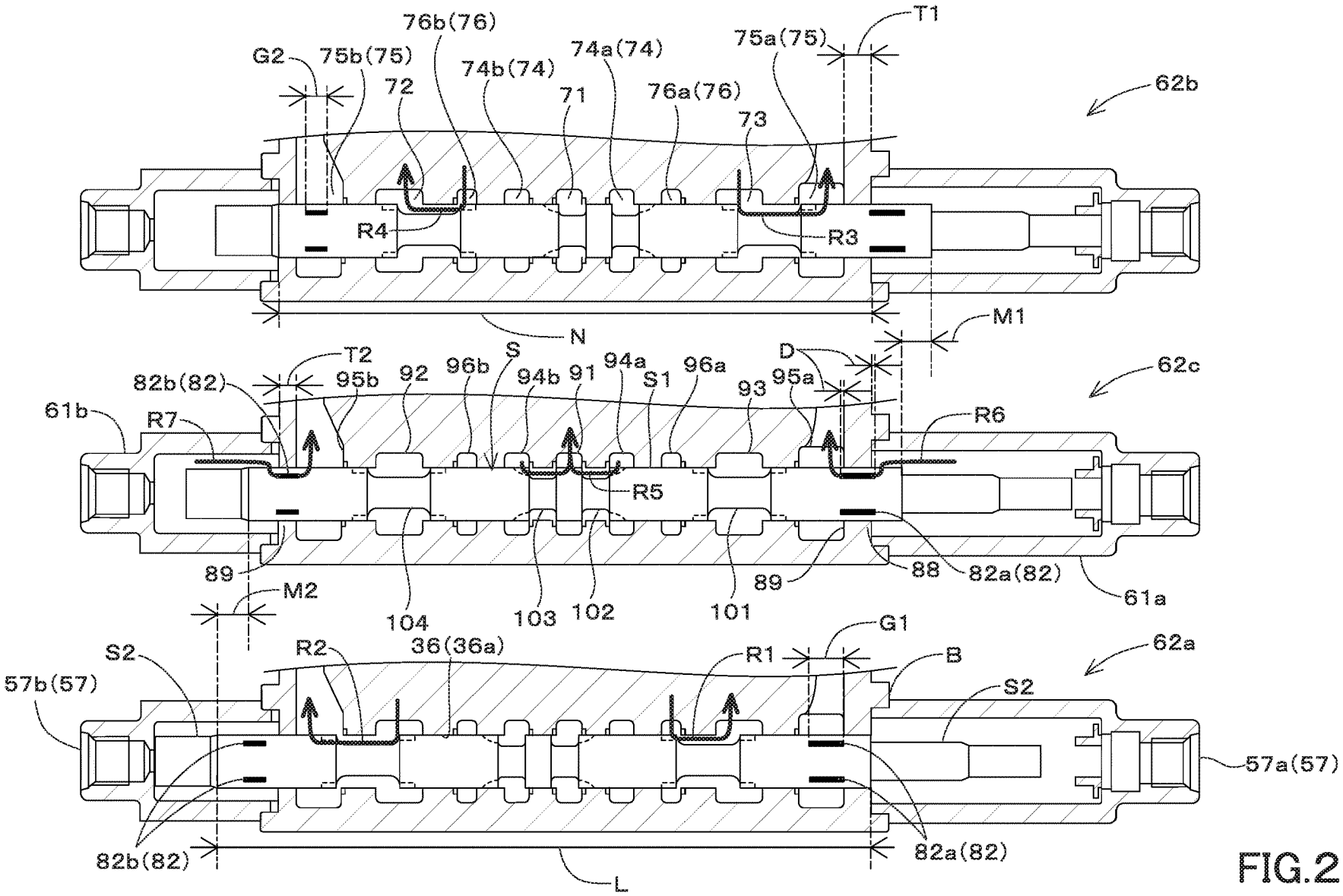
FIG. 2 is an internal view of a control valve according to the first embodiment.

As shown in FIG. 2, the third control valve 56C includes a body B. The body B is formed of a casting or a resin. The first control valve 56A and the second control valve 56B each have the identical body B. That is, although the body B is a common member shared by the first control valve 56A, the second control valve 56B, and the third control valve 56C, each of the control valves 56 may be provided with the body B individually.

As shown in FIG. 1, the body B corresponding to the third control valve 56C has a plurality of ports through which the operation fluid flows. That is, the body B has a first port 111, a second port 112, a third port 113, a fourth port 114, a fifth port 115, and a sixth port 116.

As shown in FIG. 2, the body B has a plurality of flow passages through which the operation fluid flows. That is, the body B has the first flow passage 71, the second flow passage 72, the third flow passage 73, the fourth flow passage 74, the fifth flow passage 75, and the sixth flow passage 76.

The first flow passage 71 is a flow passage formed in the body B. The first flow passage 71 is a flow passage connected to the first port 111. The first flow passage 71 is coupled to the discharge fluid tube 42 connected to the operation fluid tank 22. Thus, the operation fluid flowing from the first flow passage 71 toward the operation fluid tank 22 enters the operation fluid tank 22 through the first port 111 and the discharge fluid tube 42.

The second flow passage 72 is a flow passage formed in the body B. The second flow passage 72 is a flow passage connected to the second port 112. The second flow passage 72 is coupled to the first supplying-discharging fluid tube 83*a* connected to the coupling member 50.

Thus, the operation fluid flowing from the second flow passage 72 to the coupling member 50 enters the coupling member 50 through the second port 112 and the first supplying-discharging passage 83*a*. In addition, the operation fluid flowing from the coupling member 50 to the third control valve 56C enters the second port 112 and the second flow passage 72 through the first supplying-discharging path 83*a*.

The third flow passage 73 is a flow passage formed in the body B. The third flow passage 73 is a flow passage connected to the third port 113. The third flow passage 73 is coupled to the second supplying-discharging fluid tube 83*b* connected to the coupling member 50.

Thus, the operation fluid flowing from the third flow passage 73 to the coupling member 50 enters the coupling member 50 through the third port 113 and the second supplying-discharging fluid tube 83*b*. In addition, the operation fluid traveling from the coupling member 50 to the third control valve 56C enters the third port 113 and the third flow passage 73 through the second supplying-discharging fluid tube 83*b*.

The fourth flow passage 74 is a flow passage formed in the body B. The fourth flow passage 74 is a flow passage connected to the fourth port 114. The fourth passage 74 is coupled to the main fluid tube 39 connected to the second hydraulic pump P2 that is configured to output the operation fluid.

In particular, the fourth flow passage 74 includes the right flow passage 74*a* and the left flow passage 74*b*. The right flow passage 74*a* is located to the right from the left flow passage 74*b*. In other words, the left flow passage 74*b* is located to the left from the right flow passage 74*a*. The right flow passage 74*a* is connected to the left flow passage 74*b* to be communicated with each other.

The fifth flow passage 75 is a flow passage formed in the body B. The fifth flow passage 75 is a flow passage connected to the fifth port 115. The fifth flow passage 75 is a flow passage for discharging the operation fluid, and is connected to the discharge fluid tube 42. That is, the operation fluid discharged to the fifth flow passage (the discharge flow passage) 75 is discharged to the operation fluid tank 22 through the fifth port 115 and the discharge fluid tube 42.

In particular, the fifth flow passage 75 includes the right flow passage 75*a* and the left flow passage 75*b*. The right flow passage 75*a* is located to the right from the left flow passage 75*b*. In other words, the left flow passage 75*b* is located to the left from the right flow passage 75*a*. The right flow passage 75*a* is connected to the left flow passage 75*b* to be communicated with each other.

The sixth flow passage 76 is a flow passage formed in the body B. The sixth flow passage 76 is a flow passage connected to the sixth port 116. The sixth flow passage 76 is connected to the main fluid tube 39 that is connected to the second hydraulic pump P2 configured to output the operation fluid.

In particular, the sixth flow passage 76 includes the right flow passage 76*a* and the left flow passage 76*b*. The right flow passage 76*a* is located to the right from the left flow passage 76*b*. In other words, the left flow passage 76*b* is located to the left from the right flow passage 76*a*. The right flow passage 76*a* is connected to the left flow passage 76*b* to be communicated with each other.

The body B is provided with a wall portion 36 (a through hole 36*a*) having an annular shape (a cylindrical shape) extending from one end (the left end) to the other end (the right end) of the body B in the lateral direction. That is, the body B is provided with a through hole 36*a* having a linear shape into which the cylindrical spool S having a columnar shape is inserted.

The first flow passage 71, the second flow passage 72, the third flow passage 73, the fourth flow passage 74, the fifth flow passage 75, and the sixth flow passage 76 reaches (are connected to) the wall portion 36 having an annular shape constituting the through hole 36*a*.

In particular, the end portion 91 of the first flow passage 71 reaches the wall portion 36. An end portion 92 of the second flow passage 72 reaches the wall portion 36. The end portion 93 of the third flow passage 73 reaches the wall portion 36. An end portion 94*a* of the right flow passage 74*a* of the fourth flow passage 74 reaches the wall portion 36. The end portion 94*b* of the left flow passage 74*b* of the fourth flow passage 74 reaches the wall portion 36. The end portion 95*a* of the right flow passage 75*a* of the fifth flow passage 75 reaches the wall portion 36.

The end portion 95*b* of the left flow passage 75*b* of the fifth flow passage 75 reaches the wall portion 36. An end portion 96*a* of the right flow passage 76*a* of the sixth flow passage 76 reaches the wall portion 36. An end portion 96*b* of the left flow passage 76*b* of the sixth flow passage 76 reaches the wall portion 36.

The end portion 91, the end portion 92, the end portion 93, the end portion 94*a*, the end portion 94*b*, the end portion 95*a*, the end portion 95*b*, the end portion 96*a*, and the end portion 96*b* are each formed to have the concave shapes.

As shown in FIG. 2, the third control valve 56C has the spool S housed in the body B and configured to move in the longitudinal direction. The spool S moves in the longitudinal direction inside the body B, whereby the connecting destinations of the first flow passage 71, the second flow passage 72, the third flow passage 73, the fourth flow passage 74, the fifth flow passage 75, and the sixth flow passage 76 are changed.

The spool S will be described in detail below.

The spool S is formed to have a columnar shape. The cylindrical spool S having the columnar shape is inserted into a through hole 36*a* formed inside the body B. The spool S has a portion (a connecting portion S1) including the first connecting portion 101, the second connecting portion 102, the third connecting portion 103, and the fourth connecting portion 104, and has a portion (a protruding portion S2) protrudes from the connecting portion S1 of the spool S.

The first connecting portion 101 can be overlapped (arranged in one direction) with the end portion 93 of the third flow passage 73, the end portion 95*a* of the right flow passage 75*a* of the fifth flow passage 75, and the end portion 96*a* of the right flow passage 76*a* of the sixth flow passage 76.

The second connecting portion 102 can be overlapped (arranged in one direction) with the end portion 91 of the first flow passage 71 and the end portion 94*a* of the right flow passage 74*a* of the fourth flow passage 74.

The third connecting portion 103 can be overlapped (arranged in one direction) with the end portion 91 of the first flow passage 71 and the end portion 94*b* of the left flow passage 74*b* of the fourth flow passage 74.

The fourth connecting portion 104 can be overlapped (arranged in one direction) with the end portion 92 of the second flow passage 72, the end portion 95*b* of the left flow passage 75*b* of the fifth flow passage 75, and the end portion 96*b* of the left flow passage 76*b* of the sixth flow passage 76.

In particular, as shown in the lower part of FIG. 2, when the third control valve 56C is in the first position 62*a*, the first connecting portion 101 is overlapped (arranged in one direction) with the end portion 93 of the third flow passage 73 and the end portion 96*a* of the right flow passage 76*a* of the sixth flow passage 76. The fourth connecting portion 104 is overlapped (arranged in one direction) with the end portion 92 of the second flow passage 72 and the end portion 95*b* of the left flow passage 75*b* of the fifth flow passage 75.

That is, the third flow passage 73 is coupled to the right flow passage 76*a* of the sixth flow passage 76 by the first connecting portion 101, and as shown by an arrowed line R1 in the lower view of FIG. 2, the operation fluid flows from the right flow passage 76*a* of the sixth flow passage 76 to the third flow passage 73.

In addition, the second flow passage 72 is coupled to the left flow passage 75*b* of the fifth flow passage 75 by the fourth connecting portion 104, and as shown by an arrowed line R2 in the lower view of FIG. 2, the operation fluid flows from the second flow passage 72 to the left flow passage 75*b* of the fifth flow passage 75.

In addition, as shown in the upper view of FIG. 2, when the third control valve 56C is in the second position 62*b*, the first connecting portion 101 is overlapped (arranged in one direction) with the end portion 93 of the third flow passage 73 and the end portion 95*a* of the right flow passage 75*a* of the fifth flow passage 75. The fourth connecting portion 104 is overlapped (arranged in one direction) with the end portion 92 of the second flow passage 72 and the end portion 96*b* of the left flow passage 76*b* of the sixth flow passage 76.

That is, the third flow passage 73 is coupled to the right flow passage 75*a* of the fifth flow passage 75 by the first connecting portion 101, and as shown an arrowed line R3 in the upper view of FIG. 2, the operation fluid flows from the third flow passage 73 to the right flow passage 75*a* of the fifth flow passage 75.

In addition, the second flow passage 72 is coupled to the left flow passage 76*b* of the sixth flow passage 76 by the fourth connecting portion 104, and as shown by an arrowed line R4 in the upper view of FIG. 2, the operation fluid flows from the left flow passage 76*b* of the sixth flow passage 76 to the second flow passage 72.

In addition, as shown in the middle view of FIG. 2, when the third control valve 56C is in the third position (the neutral position) 62*c*, the second connecting portion 102 is overlapped (arranged in one direction) with the end portion 91 of the first flow passage 71 and the end portion 94*a* of the right flow passage 74*a* of the fourth flow passage 74. The third connecting portion 103 is overlapped (arranged in one direction) with the end portion 91 of the first flow passage 71 and the end portion 94*b* of the right flow passage 74*b* of the fourth flow passage 74.

That is, the first flow passage 71, the right flow passage 74*a* of the fourth flow passage 74, and the left flow passage 74*b* of the fourth flow passage 74 are coupled by the second connecting portion 102 and the third connecting portion 103.

Thus, when the third control valve 56C is set to the third position (the neutral position) 62*c*, the operation fluid supplied to the third control valve 56C through the fourth flow passage 74 is discharged to the hydraulic fluid tank 22 through the first flow passage 71 and the discharge fluid tube 42 as shown by an arrowed line R5 in the middle view of FIG. 2.

The protruding portion S2 protrudes from the left end and the right end of the connecting portion S1 and protrudes from the body B. The protruding portion S2 has a cylindrical shape, and the outer diameter is smaller than the outer diameter of the connecting portion S1.

Here, the moving amount of the spool S is referred to as the moving amount M1 from the third position 62*c* to the first position 62*a*, and is referred to as the moving amount M2 from the third position 62*c* to the second position 62*b*. In the present embodiment, when the spool S is in the third position (the neutral position) 62*c*, the connecting portion S1 protrudes in or over the moving amount M1 from the right end of the body B and protrudes in or over the moving amount M2 from the left end of the body B.

In other words, the length L of the connecting portion S1 in the longitudinal direction is longer by the maximum moving amount M of the spool S (the moving amount from the first position to the second position, that is, M1+M2) or more than the length N of the body B in the left-right direction (L≥N+M).

In addition, the body B also has a pressure receiving portion to which the operation fluid (the pilot fluid) applied to the spool S is supplied. The pressure receiving portion includes a pressure receiving portion 61*a* and a pressure receiving portion 61*b*. The pressure receiving portion 61*a* has a first supplying-discharging port 57*a* and houses one of the protruding portions S2.

The pressure receiving portion 61*b* has a second supplying-discharging port 57*b* and houses the other one of the protruding portions S2. The pressure receiving portion 61*a* is provided on one side (for example, on the right end) of the spool S. The pressure receiving portion 61*b* is provided on the other side (for example, on the left end) of the spool S.

When the operation fluid is supplied from the first control fluid tube 86*a* and/or the second control fluid tube 86*b* to the pressure receiving portion 61*a* and/or the pressure receiving portion 61*b*, the protruding portion S2 of the spool S is pressurized, and the spool S moves to a lower pressure side between the pressure in the pressure receiving portion 61*a* and the pressure in the pressure receiving portion 61*b*.

Now, in the present embodiment, the spool S has a coupling fluid tube 82. In particular, the coupling fluid tube 82 is provided on one side of the spool S and on the other side of the spool S. The coupling fluid tube 82 includes the coupling fluid tubes 82*a* and 82*b* that couple the pressure receiving portions (the pressure receiving portion 61*a* and the pressure receiving portion 61*b*) to the fifth flow passage (the discharge flow passage) 75.

To explain in particular, the coupling fluid tube 82 includes a first coupling fluid tube 82*a* and a second coupling fluid tube 82*b*. The first coupling fluid tube 82*a* is configured to couple the inside of the pressure receiving portion 61*a* to the right flow passage 75*a* of the fifth passage 75. The second coupling fluid tube 82*b* is configured to couple the inside of the pressure receiving portion 61*b* to the left flow passage 75*b* of the fifth passage 75. Hereinafter, the fifth flow passage 75 may be referred to as a discharge flow passage 75.

As shown in FIG. 2, the first coupling fluid tube 82*a* includes a plurality of fluid passages that are grooves extending in the longitudinal direction of the spool S. The first coupling fluid tube 82*a* is provided on the outer circumferential surface of the right end of the spool S.

The length G1 of the first coupling fluid tube 82*a* in the longitudinal direction is longer than a thickness T1 of an outer wall 88 between the outer circumferential surface of the body B and the right flow passage 75*a* of the discharge flow passage 75 (the distance between the left end portion of the pressure receiving portion 61*a* and a wall portion constituting the right flow passage 75*a*) (G1>T1), and the first coupling fluid tube 82*a* is opened when the spool S is at least in the third position 62*c*.

That is, when the spool S moves by a distance D from the neutral position 62*c* to the predetermined position, the first coupling fluid tube 82*a* is closed (G1≤T1+2D).

In addition, when the spool S is in the third position 62*c*, the first coupling fluid tube 82*a* is arranged such that the central portion of the first coupling fluid tube 82*a* in the longitudinal direction is arranged in one direction with the central portion of the thickness width T1 of the outer wall 88. Only when the spool S is in the third position (the neutral position) 62*c*, the inside of the pressure receiving portion 61*a* is coupled to the right flow passage 75*a*.

The second coupling fluid tube 82*b* includes a plurality of fluid tubes which are grooves extending in the longitudinal direction of the spool S. The second coupling fluid tube 82*b* is provided on the outer circumferential surface of the left end of the spool S. The length G2 of the second coupling fluid tube 82*b* in the longitudinal direction is longer than a thickness T2 of an outer wall 89 between the outer circumferential surface of the body B and the left flow passage 75*b* of the discharge flow passage 75 (the distance between the right end portion of the pressure receiving portion 61*b* and a wall portion constituting the second coupling fluid tube 82*b*) (G2>T2), and the second coupling fluid tube 82*b* is opened when the spool S is at least in the third position 62*c*.

That is, when the spool S moves by the distance D from the neutral position 62*c* to the predetermined position, the second coupling fluid tube 82*b* is closed (G2≤T2+2D).

In addition, when the spool S is in the third position 62*c*, the second coupling fluid tube 82*b* is arranged such that the central portion of the second coupling fluid tube 82*b* in the longitudinal direction is arranged in one direction with the central portion of the thickness width T2 of the outer wall 89. Only when the spool S is in the third position (the neutral position) 62*c*, the inside of the pressure receiving portion 61*b* is coupled to the left flow passage 75*b*.

In the present embodiment, the first coupling fluid tube 82*a* is constituted of a plurality of fluid tubes extending in the longitudinal direction of the spool S, and the second coupling fluid tube 82*b* is constituted of a plurality of fluid tubes extending in the longitudinal direction of the spool S.

Figure 7:
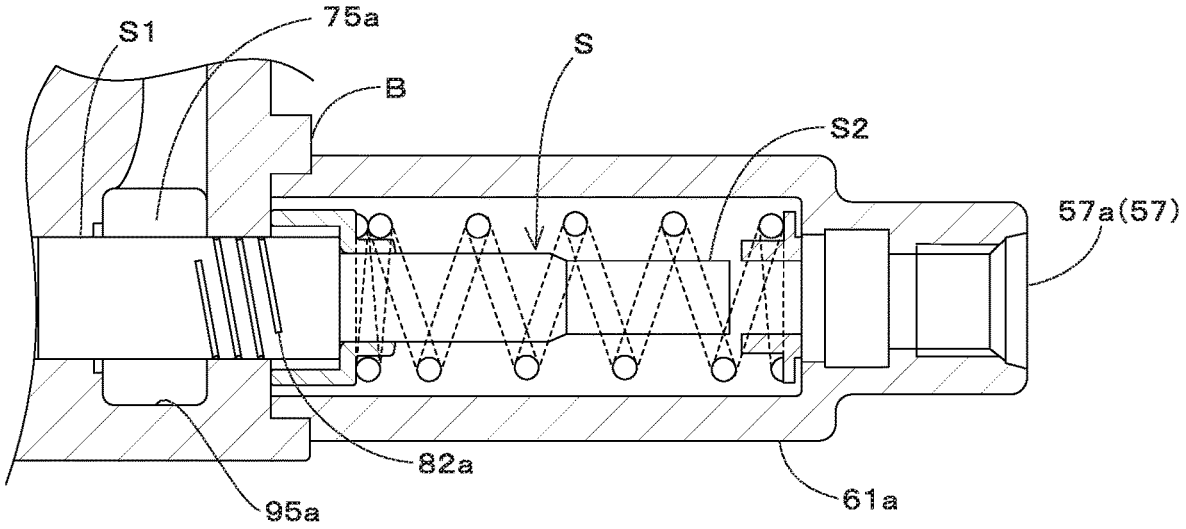
FIG. 7 is a view illustrating a modified example according to the first embodiment.

Here, the coupling fluid tube 82 needs to be configured to couple the pressure receiving portions 61*a* and 61*b* to the discharge passage 75, and the first coupling fluid tube 82*a* and the second coupling fluid tube 82*b* may be constituted of spiral grooves or the like as shown in FIG. 7.

That is, when the third control valve 56C is in the third position 62*c*, the inside of the pressure receiving portion 61*a* is coupled to the end portion 95*a* of the right flow passage 75*a* of the discharge flow passage 75. That is, the inside of the pressure receiving portion 61*a* is coupled to the right flow passage 75*a* of the discharge flow passage 75.

Thus, the operation fluid (the pilot fluid) that has flowed to the inside of the pressure receiving portion 61*a* through the first control fluid tube 86*a* is discharged to the hydraulic fluid tank 22 through the discharge flow passage 75, the fifth port 115, and the discharge fluid tube 42 as shown by an arrowed line R6 in the middle view of FIG. 2.

In addition, when the third control valve 56C is in the third position 62*c*, the inside of the pressure receiving portion 61*b* is coupled to the end portion 95*b* of the left flow passage 75*b* of the discharge flow passage 75. That is, the inside of the pressure receiving portion 61*b* is coupled to the left flow passage 75*b* of the discharge flow passage 75.

Thus, the pilot fluid that has flowed to the inside of the pressure receiving portion 61*b* through the second control fluid tube 86*b* is discharged to the hydraulic fluid tank 22 through the discharge flow passage 75, the fifth port 115, and the discharge fluid tube 42 as shown by an arrowed line R7 in the middle view of FIG. 2.

The control valve described above has the pressure receiving portions 61*a* and 61*b* to which the pilot fluid applied to the spool S is supplied and has a discharge flow passage 75 in which the pilot fluid flows. In addition, the spool S has the coupling fluid tubes 82*a* and 82*b* coupling the insides of the pressure receiving portions 61*a* and 61*b* to the discharge flow passage 75.

In this manner, when the pilot fluid is supplied to the insides of the pressure receiving portions 61*a* and 61*b* respectively provided on one side and the other side of the spool S, the supplied pilot fluid can be discharged to the operation fluid tank 22 through the coupling fluid tubes 82*a* and 82*b* respectively arranged in one direction and the other direction, the discharge flow passage 75, the fifth port 115, and the discharge fluid tube 42.

For example, when the operation member 99 is constituted of two push-type switches, both of the control fluid tubes 86*a* and 86*b* can be warmed up by simultaneously operating the two push-type switches 99.

In particular, when two of the push-type switches 99 are operated simultaneously, the control device 90 magnetizes the first proportional valve 60A and the second proportional valve 60B, and thereby the opening apertures of the first proportional valve 60A and the second proportional valve 60B are adjusted (controlled). Both of the first proportional valve 60A and the second proportional valve 60B are simultaneously opened, and then the pilot fluid is supplied to the pressure receiving portions 61*a* and 61*b* of the third control valve 56C through the control fluid tubes 86*a* and 86*b*.

In this manner, the pilot fluid supplied to the pressure receiving portions 61*a* and 61*b* is applied to the pressure receiving portions 61*a* and 61*b* of the third control valve 56C, and the spool S is held at the third position (the neutral position) 62*c*. The supplied pilot fluid is discharged to the operation fluid tank 22 through the coupling fluid tubes 82*a* and 82*b* respectively arranged in one direction and the other direction, the discharge flow passage 75, the fifth port 115, and the discharge fluid tube 42.

That is, with the spool S held at the third position (the neutral position) 62*c*, it is possible to warm up both of the control fluid tubes 86*a* and 86*b*. Meanwhile, the present invention is also applicable to the first control valve 56A and to the second control valve 56B.

For example, when the first control valve 56A has the coupling fluid tube 82 and the first control valve 56A is operated by the plurality of operation levers 58, it is possible to warm up both of the fluid tubes 43*a* and 43*c*. In particular, when the plurality of operation levers 58 are simultaneously operated and both of the pilot valves 59A and 59B are simultaneously opened, the pilot fluid of both fluid tubes 43*a* and 43*c* flows to the discharge flow passage 75 through the coupling fluid tube 82. The pilot fluid that has flowed to the discharge fluid tube 75 is discharged to the operation fluid tank 22 through the discharge fluid tube 42.

As the result, it is possible to warm up both of the fluid tubes 43*a* and 43*c* connected to the first control valve 56A. In the same manner, when the second control valve 56B has the coupling fluid tube 82 and the second control valve 56B is operated by the plurality of operation levers 58, it is possible to warm up both of the fluid tubes 43*b* and 43*d*.

In particular, when the plurality of operation levers 58 are operated at the same time and both of the pilot valves 59C and 59D are simultaneously opened, the pilot fluid of both fluid tubes 43*b* and 43*d* flows to the discharge passage 75 through the coupling fluid tube 82. The pilot fluid that has flowed to the discharge fluid tube 75 is discharged to the operation fluid tank 22 through the discharge fluid tube 42. In this manner, it is possible to warm up both of the fluid tubes 43*b* and 43*d* connected to the second control valve 56A.

In addition, a configuration configured to warm up both of the control fluid tubes 86*a* and 86*b* without the operation of the operation member 99. In particular, the setting member 100 is connected to the control device 90. For example, the setting member 100 is constituted of a push-type push switch or the like.

When the push-type switch 100 is pushed in, the control device 90 magnetizes the first proportional valve 60A and the second proportional valve 60B to adjust (control) the opening apertures of the first proportional valve 60A and the second proportional valve 60B.

Thus, both of the first proportional valve 60A and the second proportional valve 60B are simultaneously opened. The pilot fluid is supplied to the pressure receiving portions 61*a* and 61*b* of the third control valve 56C through the first control fluid tube 86A and the second control fluid tube 86B.

In this manner, the pilot fluid supplied to the pressure receiving portions 61*a* and 61*b* is discharged to the operation fluid tank 22 through the coupling fluid tubes 82*a* and 82*b* respectively arranged in one direction and in the other direction, the discharge flow passage 75, the fifth port 115, and the discharge fluid tube 42.

That is, when the warm-up mode is set by pushing the push-type switch 100, it is possible to warm up both of the control fluid tubes 86*a* and 86*b* while holding the spool S at the third position (the neutral position) 62*c*. On the other hand, when the push type switch 100 is released, the warm-up mode can be released.

In addition, the coupling fluid tubes 82*a* and 82*b* respectively couple the pressure receiving portions 61*a* and 61*b* to the discharge flow passage 75 when the spool S moves to the neutral position. In this manner, when the third control valve 56C is in the third position (the neutral position) 62*c*, it is possible to warm up the control fluid tubes 86*a* and 86*b* to be used for moving the third control valve 56C.

Moreover, the coupling fluid tubes 82*a* and 82*b* are provided on the outer circumferential surface of the spool S, and the end portion includes the grooves (the right flow passage 82*a* and the left flow passage 82*b*) whose ends correspond to the longitudinal direction of the spool S. In this manner, the warm-up can be performed only by changing the configuration of the spool S without significantly changing the whole configuration of the hydraulic circuit.

Second Embodiment

Figure 3:
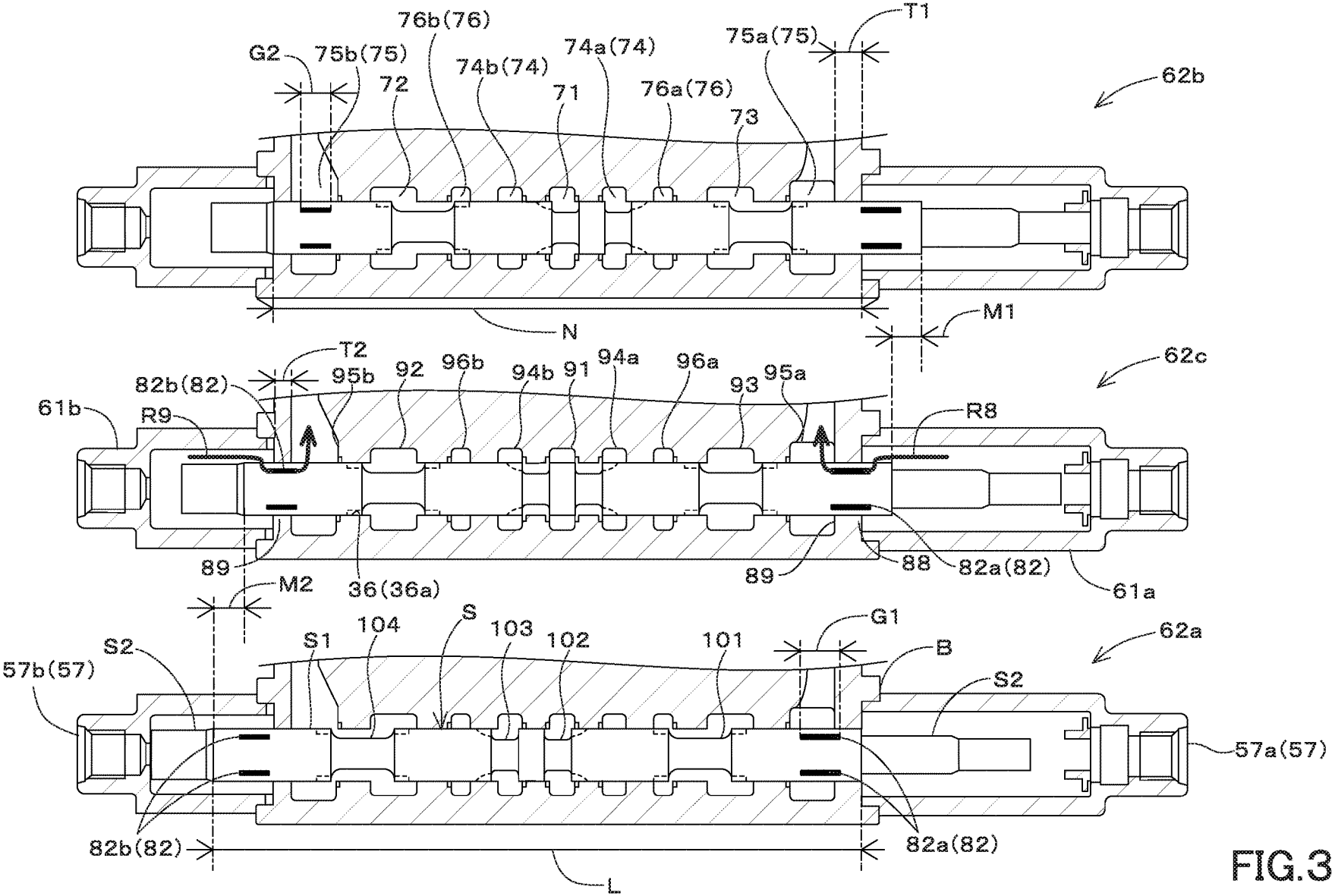
FIG. 3 is an internal view of a control valve according to a second embodiment of the present invention.

FIG. 3 shows a second embodiment of the control valve 56 according to the present invention. The control valve 56 according to the second embodiment can be applied to the control valve 56 according to the first embodiment described above. The descriptions of the same configuration as those of the first embodiment will be omitted.

As shown in FIG. 3, the first coupling fluid tube 82*a* is constituted of a plurality of fluid tubes extending in the longitudinal direction of the spool S. In addition, the first coupling fluid tube 82*a* is provided on the outer circumferential surface of the right end of the spool S. The length G1 of the first coupling fluid tube 82*a* in the longitudinal direction is longer than the thickness T1 of the outer wall 88 between the outer circumferential surface of the body B and the right flow passage 75*a* of the discharge flow passage 75.

In addition, the length G1 of the first coupling fluid tube 82*a* in the longitudinal direction is shorter than the sum of the thickness T1 of the outer wall 88 and the maximum moving amount M of the spool S ($T1<G1<T1+M$). Further, the first coupling fluid tube 82*a* is arranged such that the central portion of the first coupling fluid tube 82*a* in the longitudinal direction is arranged in one direction with the central portion of the thickness width T1 of the outer wall 88 when the spool S is in the third position 62*c*. When the spool S is positioned in a range from the middle portion between the first position 62*a* and the third position 62*c* to the middle portion between the second position 62*b* and the third position 62*c*, the inside of the pressure receiving portion 61*a* is coupled to the right flow passage 75*a*.

The second coupling fluid tube 82*b* is constituted of a plurality of fluid tubes extending in the longitudinal direction of the spool S. In addition, the second coupling fluid tube 82*b* is provided on the outer circumferential surface of the left end of the spool S. The length G2 of the second coupling fluid tube 82*b* in the longitudinal direction is longer than the thickness T2 of the outer wall 89 between the outer circumferential surface of the body B and the left flow passage 75*b* of the discharge flow passage 75. The second coupling fluid tube 82*b* is shorter than the sum of the thickness T2 of the outer wall 89 and the maximum moving amount M of the spool S ($T2<G2<T2+M$).

Further, the second coupling fluid tube 82*b* is arranged such that the central portion of the second coupling fluid tube 82*b* in the longitudinal direction is arranged in one direction with the central portion of the thickness width T2 of the outer wall 89 when the spool S is at the third position 62*c*. When the spool S is positioned in a range from the middle portion between the first position 62*a* and the third position 62*c* to the middle between the second position 62*b* and the third position 62*c*, the inside of the pressure receiving portion 61*b* is coupled to the left flow passage 75*b*.

That is, when the spool S is positioned within a predetermined range from the neutral position 62*c*, the coupling flow passages (the right side flow passage 82*a* and the left side flow passage 82*b*) couple the pressure receiving portions (the pressure receiving portion 61*a* and the pressure receiving portion 61*b*) to the discharge fluid tube 42 through the fifth port 115 and the discharge flow passage 75.

That is, when the third control valve 56C is positioned in a range from the middle portion between the first position 62*a* and the third position 62*c* to the middle portion between the second position 62*b* and the third position 62*c*, the inside of the pressure receiving portion 61*a* is coupled to the right flow passage 75*a* of the discharge flow passage 75. Thus, the pilot fluid that has flowed into the pressure receiving portion 61*a* through the first control fluid tube 86*a* is discharged to the operation fluid tank 22 through the discharge flow passage 75, the fifth port 115, and the discharge fluid tube 42, as indicated by an arrowed line R8 in the middle view of FIG. 3.

In addition, when the third control valve 56C is positioned in a range from the middle portion between the first position 62*a* and the third position 62*c* to the middle portion between the second position 62*b* and the third position 62*c*, the inside of the pressure receiving portion 61*b* is coupled to the left flow passage 75*b* of the discharge flow passage 75. Thus, the pilot fluid that has flowed into the pressure receiving portion 61*b* through the second control fluid tube 86*b* is discharged to the operation fluid tank 22 through the discharge flow passage 75, the fifth port 115, and the discharge fluid tube 42, as shown by an arrowed line R9 in the middle view of FIG. 3.

The coupling fluid tubes 82*a* and 82*b* described above couple the pressure receiving portions 61*a* and 61*b* to the discharge fluid tube 42 when the spool S is within a predetermined range from the neutral position 62*c*. In this manner, when the third control valve 56C is within a predetermined range from the third position (the neutral position) 62*c*, it is possible to warm up the control fluid tubes 86*a* and 86*b* to be used for moving the third control valve 56*c*.

In the present embodiment, the thicknesses T1 and T2 of the outer wall 89 are different in length from each other. However, the thicknesses T1 and T2 may be the same.

Third Embodiment

Figure 4:
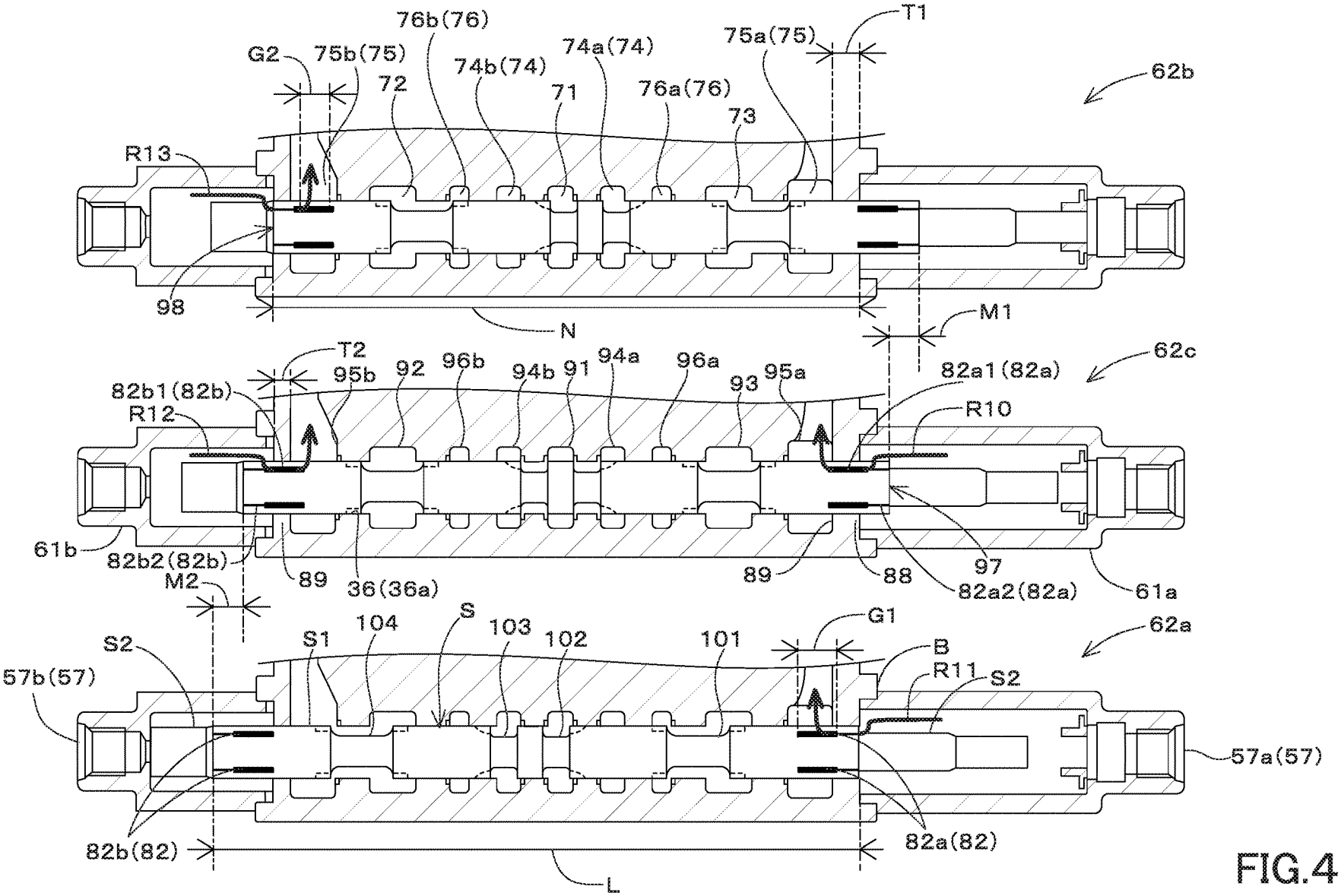
FIG. 4 is an internal view of a control valve according to a third embodiment of the present invention.

FIG. 4 shows a third embodiment of the control valve according to the present invention. The control valve 56 according to the third embodiment can be adopted to the control valve 56 according to the first embodiment and the second embodiment described above. In addition, the descriptions of the same configuration s as those of the first embodiment or the second embodiment will be omitted.

Figure 6:
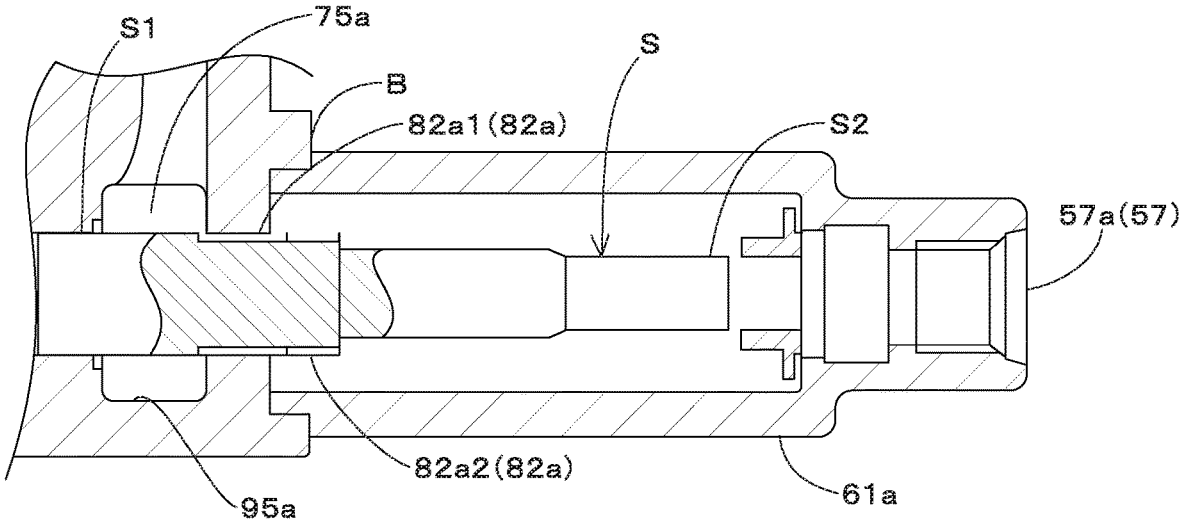
FIG. 6 is a cross-sectional view of a spool of the control valve according to the third embodiment.

As shown in FIG. 4 and FIG. 6, the first coupling fluid tube 82*a* is constituted of a plurality of fluid tubes extending in the longitudinal direction of the spool S. The first coupling fluid tube 82*a* is provided on the outer circumferential surface of the right end of the spool S. The first coupling fluid tube 82*a* includes a first large flow passage 82*a*1 and a first small flow passage 82*a*2 which have sizes different from each other. In particular, in the first large flow passage 82*a*1 and the first small flow passage 82*a*2, the first large flow passage 82*a*1 has a size larger than a size of the first small flow passage 82*a*2 in the direction orthogonal to the longitudinal direction.

In addition, as shown in FIG. 4, the first large flow passage 82*a*1 and the first small flow passage 82*a*2 are arranged in linear and connected to each other. In the first large flow passage 82*a*1 and the first small flow passage 82*a*2, it is preferred that the size of the first large flow passage 82*a*1 is larger than the size of the first small flow passage 82*a*2 in the direction orthogonal to the longitudinal direction. However, the sizes of the first large flow passage 82*a*1 and the first small flow passage 82*a*2 are not limited to the configuration mentioned above.

For example, the width from one end of the first large flow passage 82*a*1 to the other end may be larger than the width from the one end of the first small flow passage 82*a*2 to the other end. In addition, the depth from one end of the first large flow passage 82*a*1 to the other end may be larger than the width from the one end of the first small flow passage 82*a*2 to the other end.

The length G1 of the first large flow passage 82*a*1 in the longitudinal direction is longer than the thickness T1 of the outer wall 88 between the outer circumferential surface of the body B and the right flow passage 75*a* of the discharge flow passage 75. The length G1 of the first large flow passage 82*a*1 in the longitudinal direction is shorter than the sum of the thickness T1 of the outer wall 88 and the maximum moving amount M of the spool S (T1<G1<T1+M). In addition, when the spool S is in the third position 62*c*, the first large flow passage 82*a*1 is arranged such that the central portion of the first large flow passage 82*a*1 in the longitudinal direction is arranged in one direction with the central portion of the thickness width T1 of the outer wall 88.

When the spool S is positioned in a range from the middle portion between the first position 62*a* and the third position 62*c* to the middle portion between the second position 62*b* and the third position 62*c*, the inside of the pressure receiving portion 61*a* is connected to the right flow passage 75*a*.

The first small flow passage 82*a*2 having a smaller size in the direction orthogonal to the longitudinal direction than the first large flow passage 82*a*1 is connected to the first large flow passage 82*a*1. The first small flow passage 82*a*2 is extended from the first large flow passage 82*a*1 to the right end surface 97 in the connecting portion of the spool S.

The second coupling fluid tube 82*b* is constituted of a plurality of fluid tubes extending in the longitudinal direction of the spool S. The second coupling fluid tube 82*b* is provided on the outer circumferential surface of the left end of the spool S. The second coupling fluid tube 82*b* includes a second large flow passage 82*b*1 and a second small flow passage 82*b*2 each having sizes different from each other.

In particular, in the second large flow passage 82*b*1 and the second small flow passage 82*b*2, the size of the second large flow passage 82*b*1 is larger than the size of the second small flow passage 82*b*2 in the direction orthogonal to the longitudinal direction.

In addition, as shown in FIG. 4, the second large flow passage 82*b*1 and the second small flow passage 82*b*2 are arranged in linear and connected to each other. In the second large flow passage 82*b*1 and the second small flow passage 82*b*2, it is preferred that the size of the second large flow passage 82*b*1 is larger than the size of the second small flow passage 82*b*2 in the direction orthogonal to the longitudinal direction. However, the sizes of the second large flow passage 82*b*1 and the second small flow passage 82*b*2 are not limited to the configuration mentioned above. For example, the width from one end of the second large flow passage 82*b*1 to the other end may be larger than the width from the one end of the second small flow passage 82*b*2 to the other end.

In addition, the depth from one end of the second large flow passage 82*b*1 to the other end may be larger than the width from the one end of the second small flow passage 82*b*2 to the other end.

The length G2 of the second large flow passage 82*b*1 in the longitudinal direction is longer than the thickness T2 of the outer wall 88 between the outer circumferential surface of the body B and the left flow passage 75*b* of the discharge flow passage 75. The second large flow passage 82*b*1 is shorter than the sum of the thickness T2 of the outer wall 89 and the maximum moving amount M of the spool S (T2<G2<T2+M).

In addition, when the spool S is in the third position 62*c*, the second large flow passage 82*b*1 is arranged such that the central portion of the second large flow passage 82*b*1 in the longitudinal direction is arranged in one direction with the central portion of the thickness width T2 of the outer wall 89. When the spool S is positioned in a range from the middle portion between the first position 62*a* and the third position 62*c* to the middle portion between the second position 62*b* and the third position 62*c*, the inside of the pressure receiving portion 61*b* is connected to the left flow passage 75*c*.

The second small flow passage 82*b*2 having a smaller size in the direction orthogonal to the longitudinal direction than the second large flow passage 82*b*1 is connected to the second large flow passage 82*b*1. The second small flow passage 82*b* is extended from the second large flow passage 82*b*1 to the left end surface 98 of the spool S in the connecting portion S1.

That is, the coupling fluid tubes (the first coupling fluid tube 82*a* and the second coupling fluid tube 82*b*) have large flow passages (the first large flow passage 82*a*1 and the second large flow passage 82*b*1) coupling the pressure receiving portions (the pressure receiving portion 61*a* and the pressure receiving portion 61*b*) to the discharge fluid tube 42 with the fifth port 115 and the discharge flow passage 75 when the spool S is within a predetermined range from the neutral position.

In addition, the coupling fluid tubes 82*a* and 82*b* are smaller than the first flow passage. The coupling fluid tubes 82*a* and 82*b* have small flow passages (the first small passage 82*a*2 and the second small passage 82*b*2) coupling the pressure receiving portions 61*a* and 61*b* to the discharge fluid tube 42 when the strokes of the coupling fluid tubes 82*a* and 82*b* from the neutral position 62*c* become the predetermined range or more.

That is, when the third control valve 56C is in a range from the middle portion between the first position 62*a* and the third position 62*c* to the middle portion between the second position 62*b* and the third position 62*c*, the inside of the pressure receiving portion 61*a* is coupled to the right flow passage 75*a* of the discharge flow passage 75 by the first large flow passage 82*a*1.

Thus, the pilot fluid supplied to the pressure receiving portion 61*a* through the first control fluid tube 86*a* is discharged to the operation fluid tank 22 through the discharge flow passage 75, the fifth port 115, and the discharge fluid tube 42, as indicated by an arrowed line R10 in the middle view of FIG. 4.

In addition, when the third control valve 56C is positioned in a range from the middle portion between the first position 62*a* and the third position 62*c* to the first position 62*a*, the inside of the pressure receiving portion 61*a* is coupled to the right flow passage 75*a* of the fourth flow passage 75 through the first small flow passage 82*a*2. Thus, the pilot fluid that has flowed into the pressure receiving portion 61*a* through the first control fluid tube 86*a* is discharged to the operation fluid tank 22 through the discharge flow passage 75, the fifth port 115, and the discharge fluid tube 42, as indicated by an arrowed line R11 in the lower view of FIG. 4.

The first small flow passage 82*a*2 is smaller than the first large flow passage 82*a*1 in size in the direction orthogonal to the longitudinal direction. Thus, the discharged amount of the pilot fluid is smaller than the discharged amount obtained when the third control valve 56C is in a range from the middle portion between the first position 62*a* and the third position 62*c* to the first position 62*a*.

In addition, when the third control valve 56C is positioned in a range from the middle portion between the first position 62*a* and the third position 62*c* to the second position 62*b*, the inside of the pressure receiving portion 61*b* is coupled to the left flow passage 75*b* of the discharge flow passage 75 through the second large flow passage 82*b*1. Thus, the pilot fluid that has flowed into the pressure receiving portion 61*b* through the second control fluid tube 86*b* is discharged to the operation fluid tank 22 through the discharge flow passage 75, the fifth port 115, and the discharge fluid tube 42, as indicated by an arrowed line R12 in the middle view of FIG. 4.

When the third control valve 56C is positioned in a range from the middle portion between the first position 62*a* and the third position 62*c* to the second position 62*b*, the inside of the pressure receiving portion 61*b* is coupled to the right flow passage 75*c* of the discharge flow passage 75 through the second small flow passage 82*b*2. Thus, the pilot fluid supplied to the pressure receiving portion 61*b* through the second control fluid tube 86*b* is discharged to the operation fluid tank 22 through the discharge flow passage 75, the fifth port 115, and the discharge fluid tube 42, as indicated by an arrowed line R13 in the upper view of FIG. 4.

The second small flow passage 82*b*2 is smaller than the second large flow passage 82*b*1 in size in the direction orthogonal to the longitudinal direction. Thus, the discharged amount of the pilot fluid is smaller than the discharged amount obtained when the third control valve 56C is in a range from the middle portion between the first position 62*a* and the third position 62*c* to the first position 62*a*.

In the third control valve 56C described above, the first large flow passage 82*a*1 and the first small flow passage 82*a*2 are arranged in linear. However, the first large flow passage 82*a*1 and the first small flow passage 82*a*2 are just required to be connected each other, and the positional relation thereof is not particularly limited.

Figure 5:
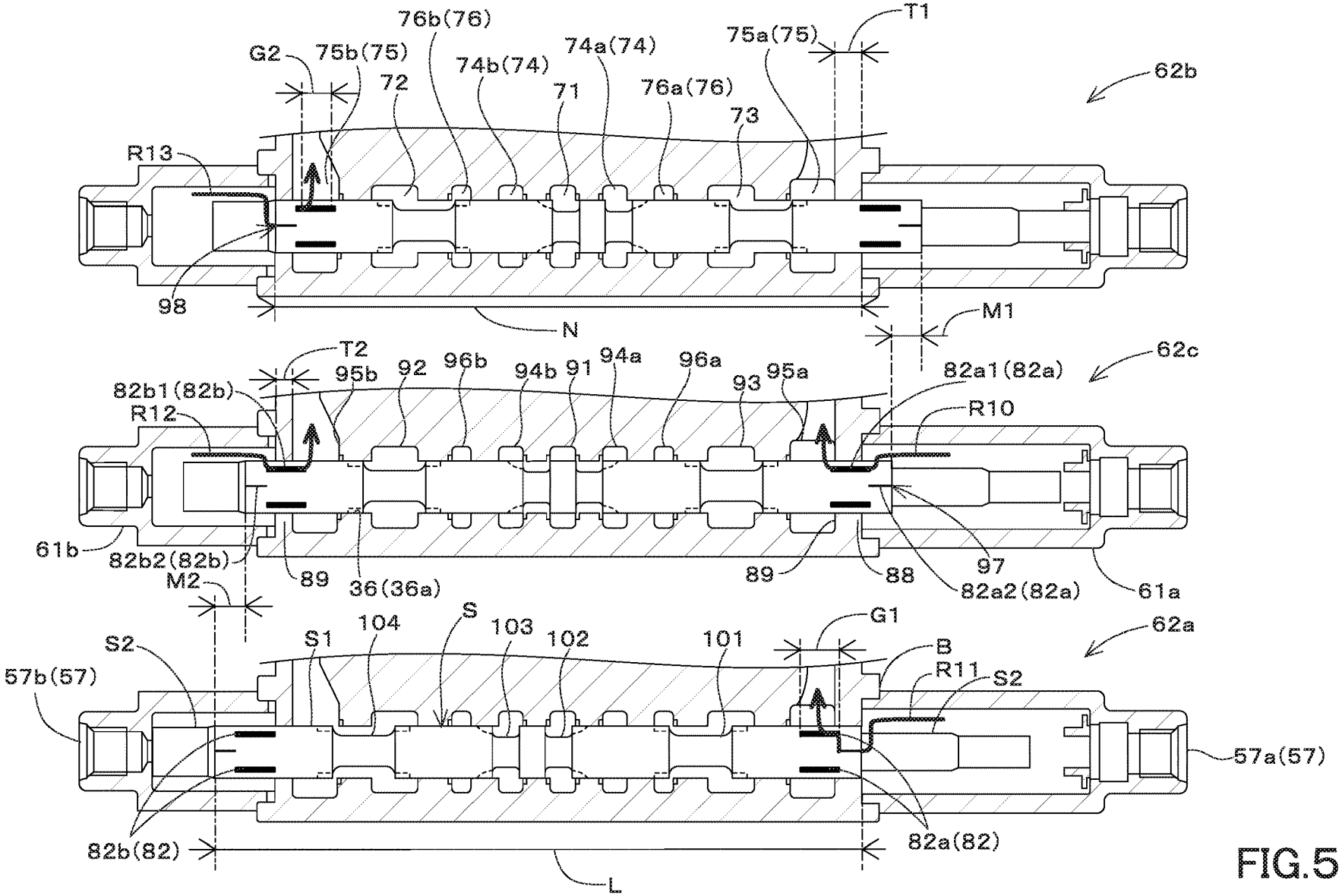
FIG. 5 is an internal view of a control valve according to a modified example of the third embodiment.

For example, as shown in FIG. 5, the positions of the first large flow passage 82*a*1 and the first small flow passage 82*a*2 may be shifted in the circumferential direction of the spool S. In that case, the right end portion of the first large flow passage 82*a*1 is overlapped (arranged in one direction) with the left end portion of the first small flow passage 82*a*2, and the first large flow passage 82*a*1 is connected to the first small flow passage 82*a*2.

In addition, although the second large flow passage 82*b*1 and the second small flow passage 82*b*2 are arranged in a straight line, the second large flow passage 82*b*1 and the second small flow passage 82*b*2 are just required to be connected each other, and the positional relation thereof is not particularly limited.

For example, as shown in FIG. 5, the positions of the second large flow passage 82*b*1 and the second small flow passage 82*b*2 may be shifted in the circumferential direction of the spool S. In that case, the left end portion of the second large flow passage 82*b*1 is overlapped (arranged in one direction) with the right end portion of the second small flow passage 82*b*2, and the second large flow passage 82*b*1 and the second small flow passage 82*b*2 are connected each other.

As described above, the coupling fluid tubes 82*a* and 82*b* respectively have large flow passages 82*a*1 and 82*b*1 configured to connect the pressure receiving portions 61*a* and 61*b* to the discharge fluid tube 42 when the spool S is positioned within a predetermined range from the neutral position 62*c*. The coupling fluid tubes 82*a* and 82*b* are smaller than the large passage 82*a*1, and respectively have small flow passages 82*a*2 and 82*b*2 configured to connect the pressure receiving portions 61*a* and 61*b* to the discharge fluid tube 42 when the spool S is positioned on or over the predetermined range from the neutral position 62*c*.

In this manner, when the third control valve 56C is positioned within a certain range from the third position (the neutral position) 62*c*, the operation fluid (the pilot fluid) supplied to the pressure receiving portions 61*a* and 61*b* is discharged through the large flow passages 82*a*1 and 82*b*1, the discharge fluid passage 75, the fifth port 115, and the discharge fluid tube 42.

In addition, when the third control valve 56C is positioned in a range from the middle portion between the first position 62*a* and the third position 62*c* to the first position 62*a*, the pilot fluid supplied to the pressure receiving portions 61*a* and 61*b* is discharged from the large flow passages 82*a*1 and 82*b*1 through the small flow passages 82*a*2 and 82*b*2 smaller than the large flow passages 82*a*1 and 82*b*1.

In the hydraulic circuit according to the embodiment, it is possible to discharge the pilot fluid of the control fluid tubes 86*a* and 86*b* and to warm up the pilot fluid when the spool S is in a certain range from the neutral position 62*c*. In addition, when the spool S is stroked for the certain range or more, that is, when the hydraulic device connected to the auxiliary attachment is operated, the amount of hydraulic fluid (the pilot fluid) to be discharged can be reduced while warming up the fluid.

Fourth Embodiment

FIG. 8 shows a fourth embodiment of the control valve according to the present invention. The fourth embodiment can be adopted to the hydraulic systems for the working machine according to the first embodiment to the third embodiment described above. In addition, the hydraulic system for the working machine according to the fourth embodiment also can be adopted to a control valve other than the control valves 56 according to the first embodiment to the third embodiment.

The descriptions of the same configurations as those of the first embodiment and the second embodiment will be omitted. That is, the hydraulic system for the working machine according to the fourth embodiment may be adopted to a control valve 56 that does not have the first coupling fluid tube 82*a*, the first large flow passage 82*b*, the first small flow passage 82*a*2, the second coupling fluid tube 82*b*, the second large flow passage 82*b*1, and the second small flow passage 82*b*2.

As shown in FIG. 8, in the output fluid tube 40, an unload switching valve 200 is connected to an upstream side of the plurality of pilot valves (the operation valves) 59A, 59B, 59C, and 59D. The unload switching valve 200 is a valve configured to be switched between to supply the operation fluid (the pilot fluid) to the operation system and to stop the supplying.

For example, the unload valve 200 is constituted of a two-position switching valve, and is switched between a first position (a stop position) 200*a* and a second position (a supply position) 200*b*. When the unload switching valve 200 is in the first position 200*a*, the unload switching valve 200 prevents the operation fluid from flowing to the plurality of pilot valves (the operation valves) 59A, 59B, 59C, and 59D, the operation fluid flowing from the output fluid tube 40 toward the plurality of pilot valves (the operation valves) 59A, 59B, 59C, and 59D for the operation system, that is, the unload switching valve 200 stops supplying the operation fluid to the operation valves.

When the unload switching valve 200 is in the second position 200*b*, the operation fluid flowing from the output fluid tube 40 toward the plurality of pilot valves (the operation valves) 59A, 59B, 59C, and 59D flows through the unload switching valve 200, and is supplied to the plurality of pilot valves (the operation valves) 59A, 59B, 59C, and 59D.

In the output fluid tube 40, a warm-up fluid tube 205 is connected to a section 40*a* between the unload switching valve 200 and the plurality of pilot valves (the operation valves) 59A, 59B, 59C, and 59D. The warm-up fluid tube 205 is a fluid tube for circulating, to the unloading valve 200, the operation fluid of a pilot fluid tube being connected to the pressure receiving portion of the control valve 56.

In particular, the warm-up fluid tube 205 is connected to a first control fluid tube 86*a* and a second control fluid tube 86*b* each of which is one of the pilot fluid tubes. A check valve 206 is connected to the warm-up fluid tube 205. The check valve 206 is configured to prevent the operation fluid (the pilot fluid) in the section 40*a* from flowing to the first control fluid tube 86*a* and the second control fluid tube 86*b* and to allow the operation fluid (the pilot fluid) in the first control fluid tube 86*a* and the second control fluid tube 86*b* to flow to the section 40*a*.

Thus, when either the first proportional valve 60A or the second proportional valve 60 is operated under the condition where the unload switching valve 200 is in the first position 200*a*, the pilot fluids of the first control fluid tube 86*a* and the second control fluid tube 86*b* flow toward the unload valve 200 in the warm-up fluid tube 205, and thus the pilot fluids can be discharged to the discharge fluid tube 203 connected to the operation fluid tank 22 or the like through the output port 201 and the discharge port 202 of the unload switching valve 200.

That is, when the unload switching valve 200 is in the first position 200*a* and the opening aperture of either one of the first proportional valve 60A and the second proportional valve 60B is larger than zero, the pilot fluid in either one of the first control fluid tube 86*a* and the second control fluid tube is circulated, and thereby the system of the third control valve 56C can be warmed up. In addition, the section 40*a* of the output fluid tube 40 also can be warmed up.

The operation of the unloading valve 200 and the operations of the first proportional valve 60A and the second proportional valve 60B are performed by the control device 210. An unload changeover switch 211 (simply referred to as an unload switch 211) and a fluid temperature detection device 212 are connected to the control device 210. The unload switch 211 is a switch configured to be switched between ON and OFF.

When the unload changeover switch 211 is OFF, the control device 210 outputs a control signal to the unload valve 200, and thereby the unload changeover valve 200 is switched to the first position 200*a*. When the unload changeover switch 211 is ON, the control device 210 outputs the control signal to the unload changeover valve 200, and thereby the unload changeover valve 200 is switched to the second position 200*b*.

The fluid temperature detection device 212 is a device configured to detect the temperature (the fluid temperature) of operation fluid such as the pilot fluid. The control device 210 is switched from the normal mode to the warm-up mode to set the opening apertures of the first proportional valve 60A and the second proportional valve 60B to be larger than zero when the fluid temperature (the detected fluid temperature) detected by the fluid temperature detection device 212 is lower than a predetermined temperature (a judgment fluid temperature) and the unload changeover switch 211 is OFF.

For example, in the warm-up mode, the control device 210 opens both of the first proportional valve 60A and the second proportional valve 60B from the state being closed, or repeatedly opens and closes the first proportional valve 60A and the second proportional valve 60B alternately. Meanwhile, the pressure set by the first proportional valve 60A and the second proportional valve 60B may be the same or may be different from each other.

In addition, the judgment fluid temperature is a temperature at which the temperature of the operation fluid is low and the viscosity of the operation fluid is high, and is set to 0° C. or less, for example. The temperature mentioned above is an example and is not limited to 0° C.

In addition, the control device 210 may operate either one of the first proportional valve 60A and the second proportional valve 60B.

When the detected fluid temperature becomes higher than the judgment fluid temperature, the control device 210 can end the warm-up mode and return to the normal mode, and can operate the control valve 56C (the auxiliary attachment) with use of the first operation member 99 in the normal mode. The control device 210 described in the fourth embodiment may be integrated with the control device 90 described in the other embodiments.

In the embodiment described above, when the detected fluid temperature becomes higher than the judgment fluid temperature, the control device 210 is configured to return from the warm-up mode to the normal mode and to operate the control valve 56C (the auxiliary attachment) with use of the first operation member 99. Instead of that, the control device 210 may carry out the operation by being arbitrarily switched to the normal mode or the warm-up mode without restriction of the control device 210 or the restriction of the detected fluid temperature.

In that case, the warm-up may be performed by operating the first operation member 99 after the operator turns off the unload changeover switch 211, for example. The operator may move the control valve 56C (the auxiliary attachment) by operating the first operation member 99 even when the detected fluid temperature is equal to or less than the judgment fluid temperature or even when the unload changeover switch 211 is turned off.

In the embodiment described above, the warm-up fluid tube 205 is connected to both the first control fluid tube 86*a* and the second control fluid tube 86*b*. However, the warm-up fluid tube 205 may be connected to either one of the first control fluid tube 86*a* and the second control fluid tube 86*b*.

As described above, the hydraulic system for the working machine according to the fourth embodiment includes the output fluid tube 40 connected to the hydraulic pump P1 for discharging the operation fluid, the unload valve 20 connected to the output fluid tube 40 and configured to be switched between to supply the operation fluid to the operation system and to stop the supplying, the hydraulic actuator configured to be operated by the operation fluid, the control valve 56C configured to control the operation fluid to be supplied to the hydraulic actuator on the basis of the pilot fluid that is the operation fluid applied to the pressure receiving portion, the pilot fluid tube (the first control fluid tube 86*a* and the second control fluid tube 86*b*) connected to the pressure receiving portion of the control valve 56C, the operation valve 60 configured to change the pressure of the pilot fluid to be applied to the pilot fluid tube, and the warm-up fluid tube 205 connected between the unload valve 200 and the pilot fluid tube.

According to that configuration, in the case where the unload valve 200 stops supplying the operation fluid to the operation system, the pilot fluid in the pilot fluid tubes (the first control fluid tube 86*a* and the second control fluid tube 86*b*) can allow the pilot fluid to flow through the warm-up fluid tube 205, and thereby the pilot fluid tube can be warmed up.

The hydraulic system for the working machine includes the check valve 206 connected to the warm-up fluid tube 205 and configured to prevent the operation fluid on the unload valve 200 side from flowing to the pilot fluid tube and to allow the operation fluid (the pilot fluid) in the pilot fluid tube to flow to the unload valve 200. According to that configuration, the pilot fluid in the pilot fluid tube can be stably circulated through the warm-up fluid tube 205.

The hydraulic system for the working machine includes the unload changeover switch 211 and the first operation member 99 to operate the operation valve 60. The unload valve 200 has a first position stopping supply of the operation fluid to the operation system through operation of the unload valve 200, and a second position supplying the operation fluid to the operation system through operation of the unload valve 200. The operation valve 60 changes the opening aperture of the operation valve 60 in accordance with operation of the first operation member 99.

When the unload valve 200 is in the second position (the supply position) 200*b*, the operation valve 60 changes the opening aperture thereof in accordance with the operation of the first operation member 99.

For example, when the operator operates the first operation member 99 after the operator operates the unload changeover switch 211 to switch the unload valve 200 to the first position (the stop position) 200*a*, the pilot fluid in the pilot fluid tube is discharged to the outside through the warm-up fluid tube 205 and the unload valve 200, and thereby the warm-up is performed.

On the other hand, in the case where the operator needs to carry out the operation, the operator operates the unload changeover switch 211 to switch the unload valve 200 to the second position (the supply position) 200*b*. In this manner, the operation can be carried out.

The hydraulic system for the working machine includes the control device 210 configured to increase the opening aperture of the operation valve 60 when the unload valve 200 is in the first position 200*a*.

According to that configuration, it is possible to easily perform the warm-up under the control by the control device 210.

The hydraulic system for the working machine is provided with the fluid temperature detection device 212 configured to detect the temperature (the fluid temperature) of the operation fluid. The control device 210 increases the opening aperture when the fluid temperature (the detected fluid temperature) detected by the fluid temperature detection device 212 is lower than a predetermined temperature (the judgment fluid temperature) and the unload valve 200 is in the first position 200*a*.

According to that configuration, the warm-up can be performed when the fluid temperature of the operation fluid is low and the viscosity thereof is high.

The hydraulic system for the working machine includes the second operation member 58 different from the first operation member 99, and the pilot valves (the pilot valves 59A, 59B, 59C, and 59D) to be operated by the second operation member 58. The warm-up fluid tube 205 connects the pilot fluid tube to the output fluid tube 40 connected to the pilot valve for the operation system.

According to that configuration, it is possible to warm up a part of the output fluid tube 40 connected to the pilot valve for the operation system.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

The hydraulic pump, the connecting configuration of the control valves, and the like are not limited to the configurations of the above-described embodiments. For example, the hydraulic pump may be constituted of a variable displacement pump, and the connecting configuration of the control valves may be in parallel (may be a parallel circuit).

What is claimed is:

1. A hydraulic system for a working machine, comprising:

a first output fluid tube connecting between a hydraulic pump to output operation fluid and a first operation valve to change a first pilot pressure of the operation fluid;

a second output fluid tube connecting between the hydraulic pump and a second operation valve to change a second pilot pressure of the operation fluid;

a switching valve provided in the second output fluid tube;

a warm-up fluid tube connected between the first operation valve and the switching valve;

a first control valve to control the operation fluid supplied to a first hydraulic actuator in accordance with the first pilot pressure; and a check valve connected between the first control valve and the warm-up fluid tube, which allows fluid communication of the operation fluid from the first control valve to the switching valve and blocks the fluid communication of the operation fluid from the switching valve to the first control valve, wherein the switching valve is switched between a first position allowing the operation fluid to be drained through the first output fluid tube, the first operation valve, the warm-up fluid tube and the switching valve, and a second position allowing the operation fluid to be supplied through second output fluid tube to the second operation valve.

2. The hydraulic system according to claim 1, comprising:

a second control valve to control the operation fluid supplied to a second hydraulic actuator in accordance with the second pilot pressure.

3. The hydraulic system according to claim 2, comprising:

an unload switch;

a first operation member to operate the first control valve; and a controller configured to control the switching valve to switch between the first position and the second position upon operation of the unload switch, and configured to control the first operation valve to change an opening aperture thereof upon operation of the first operation member.

4. The hydraulic system according to claim 3, wherein the first operation valve changes the first pilot pressure of the operation fluid in accordance with the opening aperture thereof.

5. The hydraulic system according to claim 3, wherein the controller is configured to control the first operation valve to increase the opening aperture thereof, when the switching valve is in the first position.

6. The hydraulic system according to claim 3, comprising a fluid temperature detection device to detect a fluid temperature of the operation fluid, wherein the controller is configured to control the first operation valve to increase the opening aperture thereof, when the fluid temperature is lower than a predetermined value and the switching valve is in the first position.

7. The hydraulic system according to claim 1, comprising:

a second operation member to operate the second operation valve, wherein the second operation valve changes the second pilot pressure of the operation fluid upon operation of the second operation member, when the switching valve is in the second position.

8. A hydraulic system for a working machine, comprising:

a first output fluid tube connecting between a hydraulic pump to output operation fluid and a first operation valve to change a first pilot pressure of the operation fluid;

a second output fluid tube connected between the hydraulic pump and a second operation valve to change a second pilot pressure of the operation fluid;

a switching valve provided in the second output fluid tube;

a warm-up fluid tube connected between the first operation valve and the switching valve;

an unload switch;

a first operation member to operate the first control valve; and a controller configured to control the switching valve, upon operation of the unload switch, to switch between a first position allowing the operation fluid to be drained through the first output fluid tube, the first operation valve, the warm-up fluid tube and the switching valve, and a second position allowing the operation fluid to be supplied through second output fluid tube to the second operation valve, wherein the controller is configured to control the first operation valve to change an opening aperture thereof upon operation of the first operation member.

9. The hydraulic system according to claim 8, comprising:

a first control valve to control the operation fluid supplied to a first hydraulic actuator in accordance with the first pilot pressure; and a second control valve to control the operation fluid supplied to a second hydraulic actuator in accordance with the second pilot pressure.

10. The hydraulic system according to claim 9, comprising:

a check valve connected between the first control valve and the warm-up fluid tube, which allows fluid communication of the operation fluid from the first control valve to the switching valve and blocks the fluid communication of the operation fluid from the switching valve to the first control valve.

11. The hydraulic system according to claim 8, comprising:

a second operation member to operate the second operation valve, wherein the second operation valve changes the second pilot pressure of the operation fluid upon operation of the second operation member, when the switching valve is in the second position.

12. The hydraulic system according to claim 8, wherein the first operation valve changes the first pilot pressure of the operation fluid in accordance with the opening aperture thereof.

13. The hydraulic system according to claim 8, wherein the controller is configured to control the first operation valve to increase the opening aperture thereof, when the switching valve is in the first position.

14. The hydraulic system according to claim 8, comprising a fluid temperature detection device to detect a fluid temperature of the operation fluid, wherein the controller is configured to control the first operation valve to increase the opening aperture thereof, when the fluid temperature is lower than a predetermined value and the switching valve is in the first position.

15. A hydraulic system for a working machine, comprising:

a first output fluid tube connecting between a hydraulic pump to output operation fluid and a first operation valve to change a first pilot pressure of the operation fluid;

a second output fluid tube connecting between the hydraulic pump and a second operation valve to change a second pilot pressure of the operation fluid;

a first control valve to control the operation fluid supplied to a first hydraulic actuator in accordance with the first pilot pressure;

a controller configured to control the first operation valve to change an opening aperture thereof upon operation of a first operation member;

a switching valve provided in the second output fluid tube; and a warm-up fluid tube connected between the first operation valve and the switching valve, wherein the switching valve is switched between a first position allowing the operation fluid to be drained through the first output fluid tube, the first operation valve, the warm-up fluid tube and the switching valve, and a second position allowing the operation fluid to be supplied through second output fluid tube to the second operation valve.

16. The hydraulic system according to claim 15, comprising:

a second control valve to control the operation fluid supplied to a second hydraulic actuator in accordance with the second pilot pressure.

17. The hydraulic system according to claim 15, comprising:

a check valve connected between the first control valve and the warm-up fluid tube, which allows fluid communication of the operation fluid from the first control valve to the switching valve and blocks the fluid communication of the operation fluid from the switching valve to the first control valve.

18. The hydraulic system according to claim 15, comprising:

a second operation member to operate the second operation valve, wherein the second operation valve changes the second pilot pressure of the operation fluid upon operation of the second operation member, when the switching valve is in the second position.

* * * * *